US012138512B2

(12) United States Patent
Andrews

(10) Patent No.: US 12,138,512 B2
(45) Date of Patent: Nov. 12, 2024

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventor: Matthew T. Andrews, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 18/102,534

(22) Filed: Jan. 27, 2023

(65) Prior Publication Data

US 2024/0017132 A1 Jan. 18, 2024

Related U.S. Application Data

(60) Provisional application No. 63/402,587, filed on Aug. 31, 2022, provisional application No. 63/390,206, filed on Jul. 18, 2022.

(51) Int. Cl.
*A63B 53/04* (2015.01)
*A63B 53/06* (2015.01)

(52) U.S. Cl.
CPC ..... *A63B 53/0433* (2020.08); *A63B 53/0412* (2020.08); *A63B 53/0487* (2013.01); *A63B 2053/0491* (2013.01)

(58) Field of Classification Search
CPC ..... A63B 53/0487; A63B 2053/0491
See application file for complete search history.

(56) References Cited

U.S. PATENT DOCUMENTS

| | | | |
|---|---|---|---|
| 922,444 A | 5/1909 | Youds | |
| RE19,178 E | 5/1934 | Spiker | |
| 3,749,408 A | 7/1973 | Mills | |

(Continued)

FOREIGN PATENT DOCUMENTS

| | | | |
|---|---|---|---|
| JP | 2005160691 A | 6/2005 | |
| JP | 2007236943 A * | 9/2007 | ..... A63B 53/0487 |

(Continued)

OTHER PUBLICATIONS

TourSpecGolf (Gold's Factory Multi Weighted Custom Putter) [online]. Nov. 20, 2010 [retrieved May 8, 2019] Retrieved from the Internet.

(Continued)

*Primary Examiner* — Alvin A Hunter

(57) ABSTRACT

Embodiments of golf club heads and methods to manufacture golf club heads are generally described herein. In one example, a golf club head includes a body portion having an opening at a sole portion and an interior cavity. A first port and a second port are located at the sole portion and are in communication with the interior cavity. A sole plate is coupled to the sole portion to cover the opening and includes a depression with a through-port in communication with the interior cavity. The interior cavity is partially or entirely filled with a first filler material and a second filler material. The first filler material is a solid polymer material and the second filler material is a foam polymer material. A sole plate cover is coupled to the depression to cover the through-port. Other examples and embodiments may be described and claimed.

20 Claims, 15 Drawing Sheets

(56) References Cited

U.S. PATENT DOCUMENTS 4,043,562 A 8/1977 Shillington
4,340,230 A 7/1982 Churchward
4,754,977 A 7/1988 Sahm
4,869,507 A 9/1989 Sahm
4,927,144 A 5/1990 Stormon
5,116,047 A 5/1992 Phelan et al.
5,127,653 A 7/1992 Nelson
5,137,275 A 8/1992 Nelson
5,193,806 A 3/1993 Burkly
D335,317 S 5/1993 Shearer
D335,692 S 5/1993 Antonious
D336,757 S 6/1993 Antonious
5,244,205 A 9/1993 Melanson et al.
5,275,412 A 1/1994 Innes
D350,582 S 9/1994 Miansian et al.
5,388,827 A 2/1995 Reynolds
5,390,918 A 2/1995 Meyers et al.
5,429,366 A 7/1995 McCabe
D363,101 S 10/1995 Sturm
5,454,563 A 10/1995 Nagamoto et al.
5,470,063 A 11/1995 Fisher
D365,864 S 1/1996 Sturm
5,489,097 A 2/1996 Simmons
D368,751 S 4/1996 Rife
D369,393 S 4/1996 Takahashi et al.
5,518,235 A 5/1996 Mendenhall
5,569,098 A 10/1996 Klein
5,571,053 A 11/1996 Lane
D378,688 S 4/1997 Cameron
5,647,807 A 7/1997 Nagamoto
D385,609 S 10/1997 Cameron
5,683,307 A 11/1997 Rife
D388,143 S 12/1997 Huan-Chiang
D389,207 S 1/1998 Cameron
5,711,719 A 1/1998 Fireman
5,720,671 A 2/1998 Cheng
5,749,793 A 5/1998 Lucetti
D398,685 S 9/1998 Masuda
5,803,824 A 9/1998 Rollingson
D399,290 S 10/1998 Sizemore, Jr.
D399,911 S 10/1998 Nicolette et al.
5,839,974 A 11/1998 McAllister
D405,836 S 2/1999 Nicolette et al.
5,890,969 A 4/1999 Bechler
D409,701 S 5/1999 Ashcraft et al.
5,924,938 A 7/1999 Hines
5,941,781 A 8/1999 Sessions
6,007,434 A 12/1999 Baker et al.
6,039,656 A 3/2000 Fireman
D422,655 S 4/2000 Hicks
6,050,903 A 4/2000 Lake
D426,276 S 6/2000 Besnard et al.
D431,854 S 10/2000 Cameron
D432,192 S 10/2000 Hicks
D436,151 S 1/2001 Nicolette et al.
D437,374 S 2/2001 Cameron
D441,820 S 5/2001 Nicolette et al.
6,234,915 B1 5/2001 Wu
D443,668 S 6/2001 Nicolette et al.
D443,905 S 6/2001 Nicolette et al.
D444,833 S 7/2001 Wells et al.
6,264,571 B1 7/2001 Lekavich
D449,664 S 10/2001 Beebe et al.
D449,865 S 10/2001 Fife, Jr. et al.
6,306,048 B1 * 10/2001 McCabe ..... A63B 53/04 473/335
D450,799 S 11/2001 Nicolette et al.
D451,973 S 12/2001 Wells et al.
6,348,014 B1 2/2002 Chiu
6,354,959 B1 3/2002 Nicolette et al.
6,394,910 B1 * 5/2002 McCarthy ..... A63B 69/3685 473/340
6,478,694 B2 11/2002 Anderson et al.
6,533,679 B1 * 3/2003 McCabe ..... A63B 60/02 473/335
D472,949 S 4/2003 Serrano
D474,821 S 5/2003 Wells et al.
D474,949 S 5/2003 Schaffeld et al.
6,561,919 B2 5/2003 Edel
D483,086 S 12/2003 Schweigert et al.
6,659,883 B2 12/2003 Nelson et al.
D486,872 S 2/2004 Schweigert et al.
D488,200 S 4/2004 Olsavsky et al.
D498,276 S 11/2004 Schweigert et al.
6,902,496 B2 6/2005 Solheim et al.
6,926,615 B1 * 8/2005 Souza ..... A63B 53/0487 473/340
D512,116 S 11/2005 Miraflor et al.
6,988,956 B2 1/2006 Cover et al.
6,997,819 B2 2/2006 Naylor et al.
D520,088 S 5/2006 Parr
7,077,760 B2 7/2006 Gray
D531,242 S 10/2006 Adams
D532,067 S 11/2006 Soracco et al.
7,153,220 B2 * 12/2006 Lo ..... A63B 60/00 473/340
D534,595 S 1/2007 Hasebe
7,156,752 B1 1/2007 Bennett
7,163,465 B2 1/2007 Edel
D536,401 S 2/2007 Kawami
D536,403 S 2/2007 Kawami
D538,371 S 3/2007 Kawami
7,201,668 B1 4/2007 Pamias
7,204,765 B2 4/2007 Cover et al.
D542,869 S 5/2007 Adams
D543,598 S 5/2007 Kuan et al.
D543,601 S 5/2007 Kawami
D555,219 S 11/2007 Lin
D556,277 S 11/2007 Broom
7,309,297 B1 12/2007 Solari
D561,854 S 2/2008 Morris
7,331,876 B2 2/2008 Klein
7,351,162 B2 4/2008 Soracco et al.
D569,461 S 5/2008 Morris
D569,930 S 5/2008 Nehrbas
7,390,267 B2 * 6/2008 Grace ..... A63B 53/0487 473/340
7,396,289 B2 7/2008 Soracco et al.
7,416,494 B2 8/2008 Edel
D577,085 S 9/2008 Nicolette et al.
D577,086 S 9/2008 Nicolette et al.
D579,506 S 10/2008 Nicolette et al.
7,438,648 B2 * 10/2008 Wahl ..... A63B 53/0487 473/340
D579,995 S 11/2008 Nicolette et al.
D582,497 S 12/2008 Rollinson
7,473,189 B2 1/2009 Schweigert et al.
7,491,131 B2 * 2/2009 Vinton ..... A63B 60/02 473/340
D595,793 S 7/2009 Rollinson
7,575,523 B2 * 8/2009 Yokota ..... A63B 53/0466 473/332
D599,425 S 9/2009 Laub
D600,763 S 9/2009 Cameron
7,588,499 B2 * 9/2009 Tateno ..... A63B 60/02 473/340
7,588,502 B2 * 9/2009 Nishino ..... A63B 60/02 473/332
7,744,485 B2 * 6/2010 Jones ..... A63B 60/02 473/409
D620,993 S 8/2010 Laub
D621,461 S 8/2010 Serrano et al.
D623,709 S 9/2010 Serrano et al.
D631,925 S 2/2011 Broom
7,887,432 B2 2/2011 Jones et al.
7,909,707 B2 3/2011 Klein
7,918,745 B2 4/2011 Morris et al.
D638,891 S 5/2011 Nicolette et al.
D642,643 S 8/2011 Nicolette et al.
D643,485 S 8/2011 Nicolette et al.
D645,104 S 9/2011 Nicolette et al.
8,096,039 B2 1/2012 Soracco et al.
D653,718 S 2/2012 Stokke et al.

(56) References Cited

U.S. PATENT DOCUMENTS

| | | | | |
|---|---|---|---|---|
| D661,753 | S | 6/2012 | Cameron et al. | |
| D666,260 | S | 8/2012 | Cynn | |
| 8,328,654 | B2 * | 12/2012 | Demkowski | A63B 53/04 473/340 |
| 8,371,958 | B2 | 2/2013 | Treadwell | |
| 8,376,878 | B2 | 2/2013 | Bennett et al. | |
| D688,339 | S | 8/2013 | Hilton et al. | |
| D688,341 | S | 8/2013 | Rollinson | |
| D691,226 | S | 10/2013 | Hilton et al. | |
| 8,636,607 | B2 | 1/2014 | Renna | |
| D699,308 | S | 2/2014 | Rollinson | |
| 8,641,556 | B2 * | 2/2014 | Kuan | A63B 60/54 473/340 |
| 8,696,492 | B1 | 4/2014 | Hocknell et al. | |
| D704,782 | S | 5/2014 | Rollinson | |
| 8,721,472 | B2 | 5/2014 | Kuan et al. | |
| 8,790,193 | B2 | 7/2014 | Serrano et al. | |
| D711,483 | S | 8/2014 | Wong | |
| D715,388 | S | 10/2014 | Serrano et al. | |
| 8,870,674 | B1 | 10/2014 | Abbott | |
| D722,350 | S | 2/2015 | Schweigert | |
| D722,351 | S | 2/2015 | Parsons et al. | |
| D722,352 | S | 2/2015 | Nicolette et al. | |
| D723,120 | S | 2/2015 | Nicolette | |
| D724,164 | S | 3/2015 | Schweigert et al. | |
| D725,208 | S | 3/2015 | Schweigert | |
| D726,265 | S | 4/2015 | Nicolette | |
| D726,846 | S | 4/2015 | Schweigert | |
| D730,462 | S | 5/2015 | Becktor et al. | |
| D732,122 | S | 6/2015 | Becktor | |
| D732,618 | S | 6/2015 | Becktor et al. | |
| D733,234 | S | 6/2015 | Nicolette | |
| 9,079,077 | B2 | 7/2015 | Wolf | |
| 9,108,092 | B1 | 8/2015 | Warner | |
| D738,447 | S | 9/2015 | Schweigert | |
| D738,449 | S | 9/2015 | Schweigert | |
| D739,487 | S | 9/2015 | Schweigert | |
| D741,426 | S | 10/2015 | Schweigert | |
| 9,180,349 | B1 * | 11/2015 | Seluga | A63B 53/0466 |
| 9,192,832 | B2 * | 11/2015 | Parsons | A63B 53/0487 |
| 9,220,960 | B2 * | 12/2015 | Schartiger | A63B 53/0487 |
| D748,213 | S | 1/2016 | Parsons et al. | |
| D748,215 | S | 1/2016 | Parsons et al. | |
| 9,227,115 | B2 * | 1/2016 | Cameron | A63B 53/04 |
| 9,233,283 | B2 | 1/2016 | Schweigert | |
| 9,272,193 | B1 | 3/2016 | Yim | |
| D753,252 | S | 4/2016 | Schweigert | |
| 9,387,375 | B2 | 7/2016 | Schweigert | |
| 9,440,124 | B2 | 9/2016 | Parsons et al. | |
| 9,545,544 | B2 | 1/2017 | Jones et al. | |
| 9,604,108 | B1 * | 3/2017 | Dunnell | A63B 60/02 |
| 9,649,540 | B2 | 5/2017 | Parsons et al. | |
| 9,675,854 | B2 | 6/2017 | Wang et al. | |
| 9,808,680 | B1 | 11/2017 | Myers et al. | |
| 9,895,585 | B2 | 2/2018 | Kroloff | |
| 9,901,792 | B2 * | 2/2018 | Franklin | A63B 53/047 |
| 9,925,427 | B2 | 3/2018 | Bischmann et al. | |
| 9,956,463 | B2 * | 5/2018 | Franklin | A63B 60/54 |
| 9,987,531 | B2 * | 6/2018 | Cameron | A63B 53/04 |
| 10,046,211 | B2 * | 8/2018 | Franklin | A63B 53/065 |
| 10,124,220 | B2 * | 11/2018 | Cameron | A63B 53/0487 |
| 10,478,680 | B2 | 11/2019 | Schweigert et al. | |
| 10,493,331 | B2 * | 12/2019 | Kroloff | A63B 60/42 |
| 10,576,339 | B2 | 3/2020 | Schweigert et al. | |
| 10,737,153 | B2 | 8/2020 | Schweigert et al. | |
| 10,821,341 | B2 | 11/2020 | Schweigert et al. | |
| 10,960,271 | B2 | 3/2021 | Kroloff et al. | |
| 10,981,038 | B2 | 4/2021 | Schweigert et al. | |
| 11,045,698 | B2 | 6/2021 | Schweigert et al. | |
| 11,135,486 | B2 * | 10/2021 | Higdon | A63B 53/0487 |
| 11,298,597 | B2 | 4/2022 | Parsons et al. | |
| 11,364,422 | B1 | 6/2022 | Parsons et al. | |
| 11,369,849 | B2 | 6/2022 | Andrews et al. | |
| 11,517,798 | B2 | 12/2022 | Kroloff et al. | |
| D994,808 | S * | 8/2023 | Cameron | D21/743 |
| 11,925,839 | B2 * | 3/2024 | Morales | B23K 20/233 |
| 2002/0077193 | A1 | 6/2002 | Takeda | |
| 2002/0193174 | A1 | 12/2002 | Edel | |
| 2003/0199332 | A1 | 10/2003 | Lindsay | |
| 2004/0014532 | A1 | 1/2004 | Lee et al. | |
| 2004/0138003 | A1 | 7/2004 | Grace | |
| 2004/0180730 | A1 | 9/2004 | Franklin et al. | |
| 2006/0052178 | A1 * | 3/2006 | Franklin | A63B 53/0487 473/340 |
| 2006/0094522 | A1 | 5/2006 | Tang et al. | |
| 2006/0223649 | A1 | 10/2006 | Rife | |
| 2007/0129163 | A1 | 6/2007 | Solari | |
| 2007/0135232 | A1 | 6/2007 | Billings | |
| 2007/0142122 | A1 | 6/2007 | Bonneau | |
| 2007/0207875 | A1 | 9/2007 | Kuan et al. | |
| 2007/0238548 | A1 | 10/2007 | Johnson | |
| 2008/0139333 | A1 | 6/2008 | Klein | |
| 2008/0146372 | A1 | 6/2008 | John | |
| 2008/0176672 | A1 | 7/2008 | Roach et al. | |
| 2009/0029800 | A1 | 1/2009 | Jones et al. | |
| 2009/0156328 | A1 | 6/2009 | Reese | |
| 2009/0163287 | A1 | 6/2009 | Vald'Via et al. | |
| 2009/0239678 | A1 | 9/2009 | Cruz et al. | |
| 2010/0035700 | A1 | 2/2010 | Yu et al. | |
| 2010/0255922 | A1 | 10/2010 | Lueders | |
| 2010/0317454 | A1 | 12/2010 | Sato et al. | |
| 2011/0165959 | A1 | 7/2011 | Klein | |
| 2013/0165256 | A1 | 6/2013 | Stevenson | |
| 2013/0210537 | A1 | 8/2013 | Ainscough et al. | |
| 2015/0306477 | A1 | 10/2015 | Parsons et al. | |
| 2016/0016050 | A1 | 1/2016 | Rife | |
| 2016/0136487 | A1 | 5/2016 | Clarke et al. | |
| 2016/0346649 | A1 | 12/2016 | Jertson et al. | |
| 2018/0001163 | A1 | 1/2018 | Becktor et al. | |
| 2018/0311545 | A1 | 11/2018 | Lambeth et al. | |
| 2018/0361206 | A1 | 12/2018 | Becktor et al. | |

FOREIGN PATENT DOCUMENTS

| | | | | |
|---|---|---|---|---|
| JP | 2008161343 | A * | 7/2008 | A63B 53/04 |
| JP | 2009106400 | A * | 5/2009 | A63B 53/0487 |
| JP | 2009247911 | A * | 10/2009 | A63B 53/0487 |
| JP | 2010099488 | A * | 5/2010 | A63B 53/0487 |
| JP | 2011167520 | A * | 9/2011 | A63B 53/04 |
| JP | 2012176230 | A * | 9/2012 | A63B 53/00 |
| JP | 2016179061 | A * | 10/2016 | A63B 53/04 |
| WO | 2006087846 | A1 | 8/2006 | |
| WO | 2015005593 | A1 | 1/2015 | |

OTHER PUBLICATIONS

U.S. Appl. No. 29/523,587, Schweigert, "Golf Club Head," filed Apr. 10, 2015.

* cited by examiner

GOLF CLUB HEADS AND METHODS TO MANUFACTURE GOLF CLUB HEADS

CROSS REFERENCE

This application claims the benefit of U.S. Provisional Application No. 63/402,587, filed Aug. 31, 2022 and U.S. Provisional Application No. 63/390,206, filed Jul. 18, 2022.

The disclosures of the above-referenced applications are incorporated by reference herein in their entirety.

GOLF CLUB HEADS AND METHODS TO MANUFACTURE GOLF CLUB HEADS COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacture golf club heads.

BACKGROUND

Various materials may be used to manufacture golf club heads. By using multiple materials to manufacture golf club heads, a moment of inertia (MOI) and/or other performance properties of a golf club head may be optimized to produce improved performance.

Figure 1:
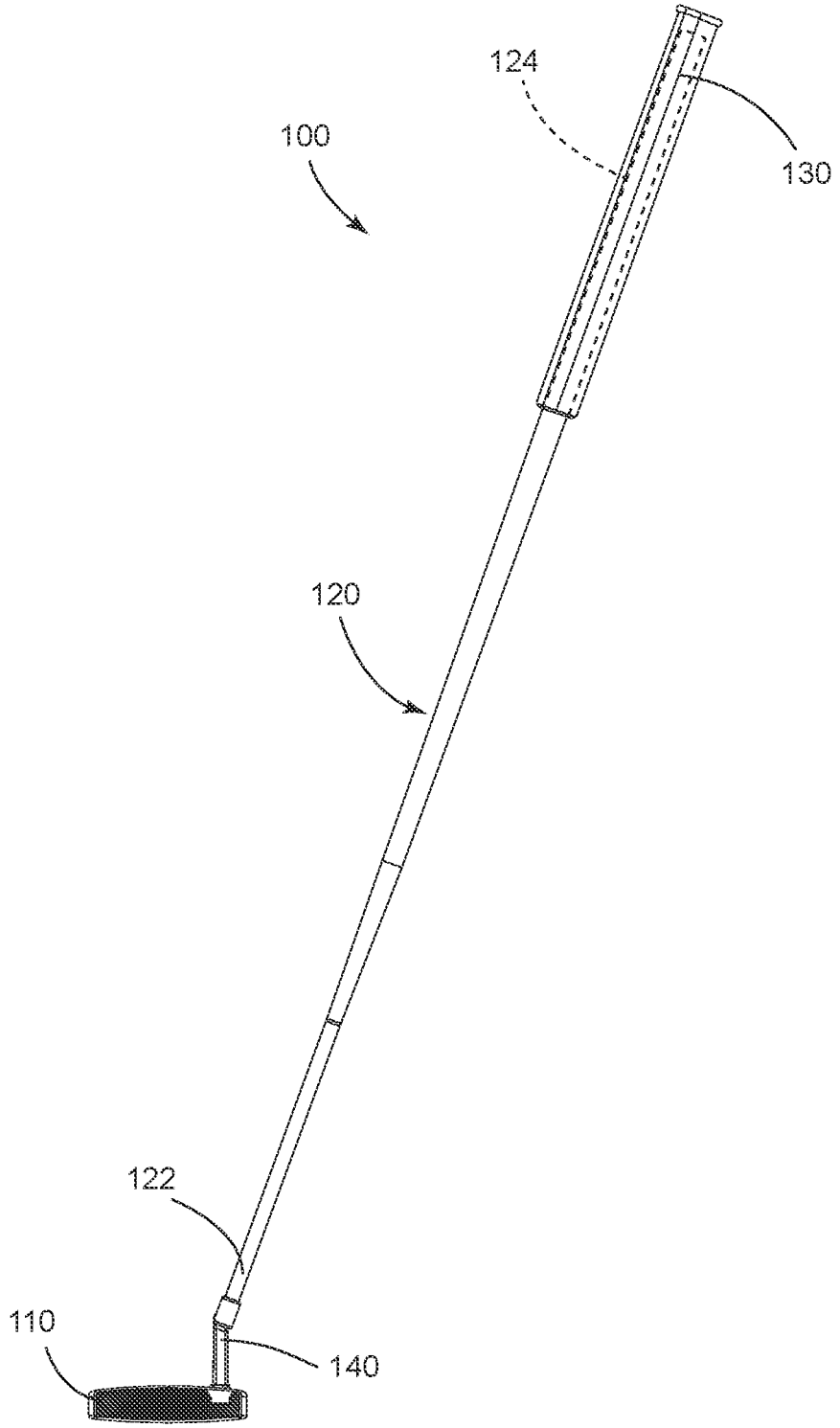
FIG. 1 depicts a front view of a golf club according to an example of the apparatus, methods, and articles of manufacture described herein.
Figure 2:
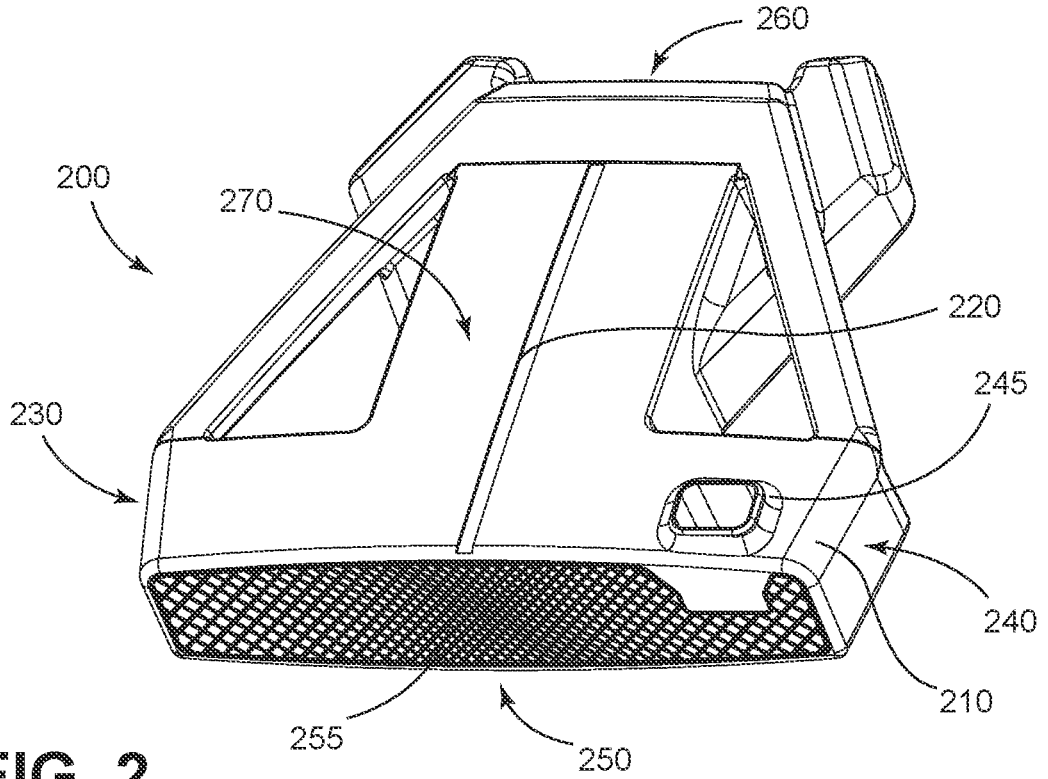
FIG. 2 depicts a front and top perspective view of a golf club head according to an example of the apparatus, methods, and articles of manufacture described herein.
Figure 3:
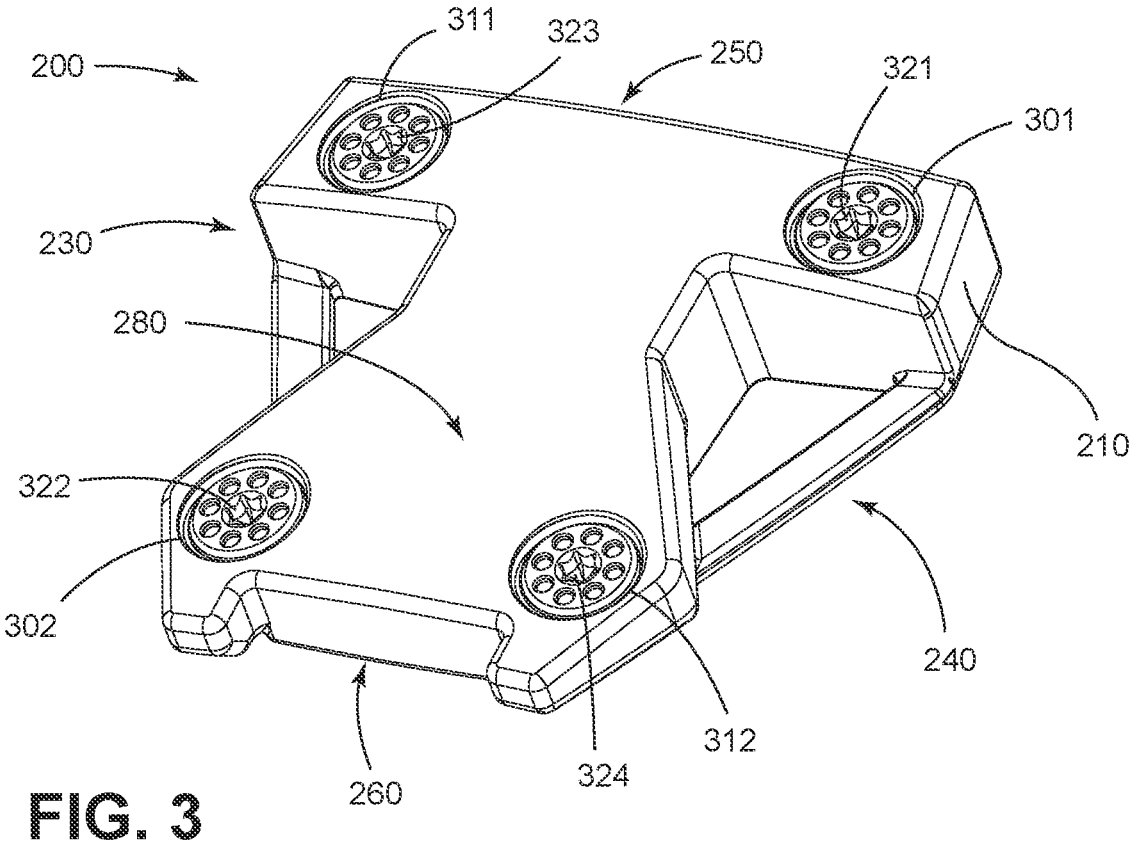
FIG. 3 depicts a rear and bottom perspective view of the golf club head of FIG. 2.
Figure 4:
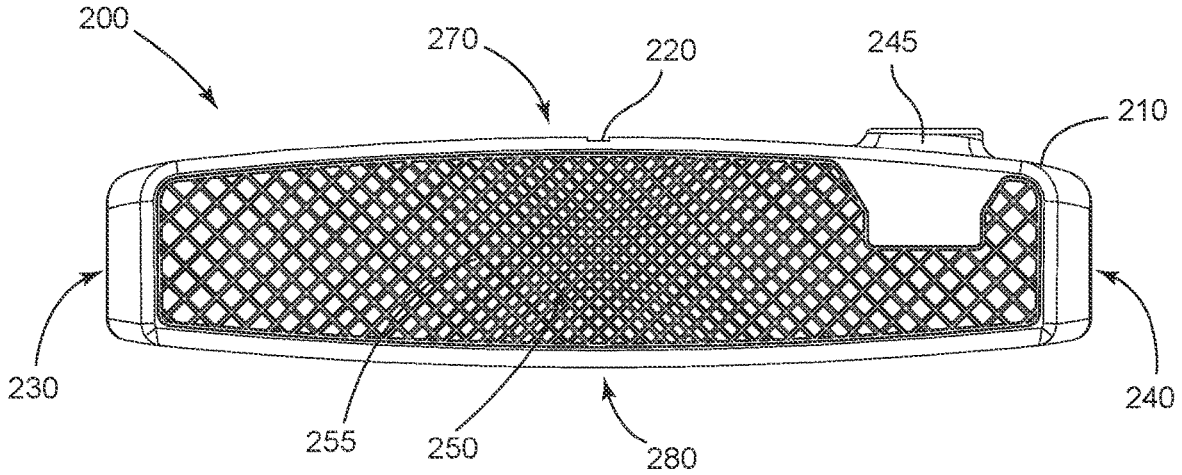
FIG. 4 depicts a front view of the golf club head of FIG. 2.
Figure 5:
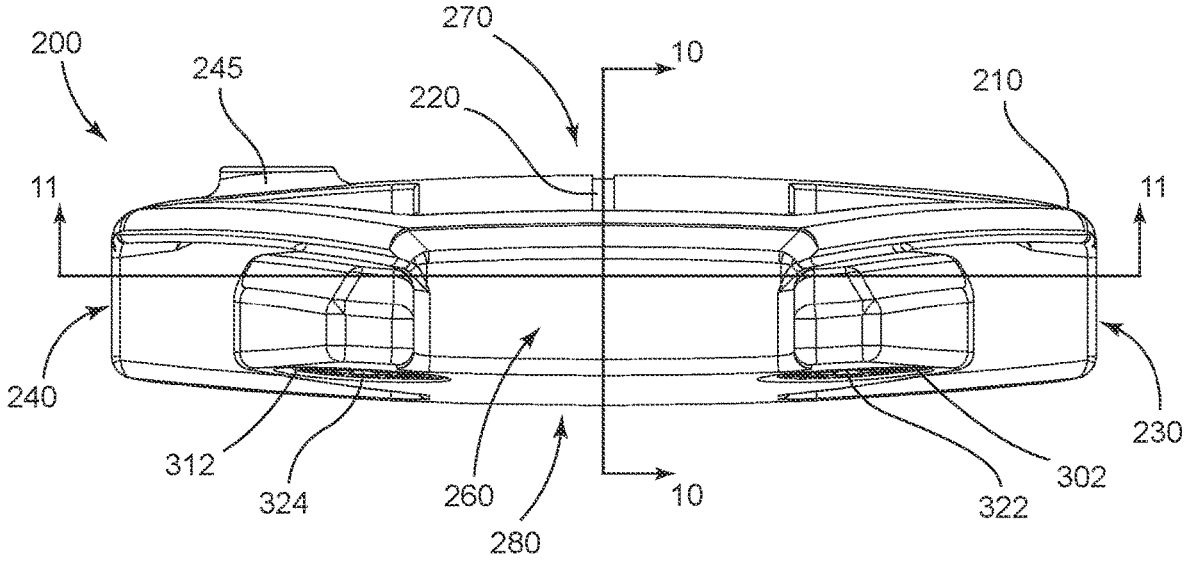
FIG. 5 depicts a rear view of the golf club head of FIG. 2.
Figure 6:
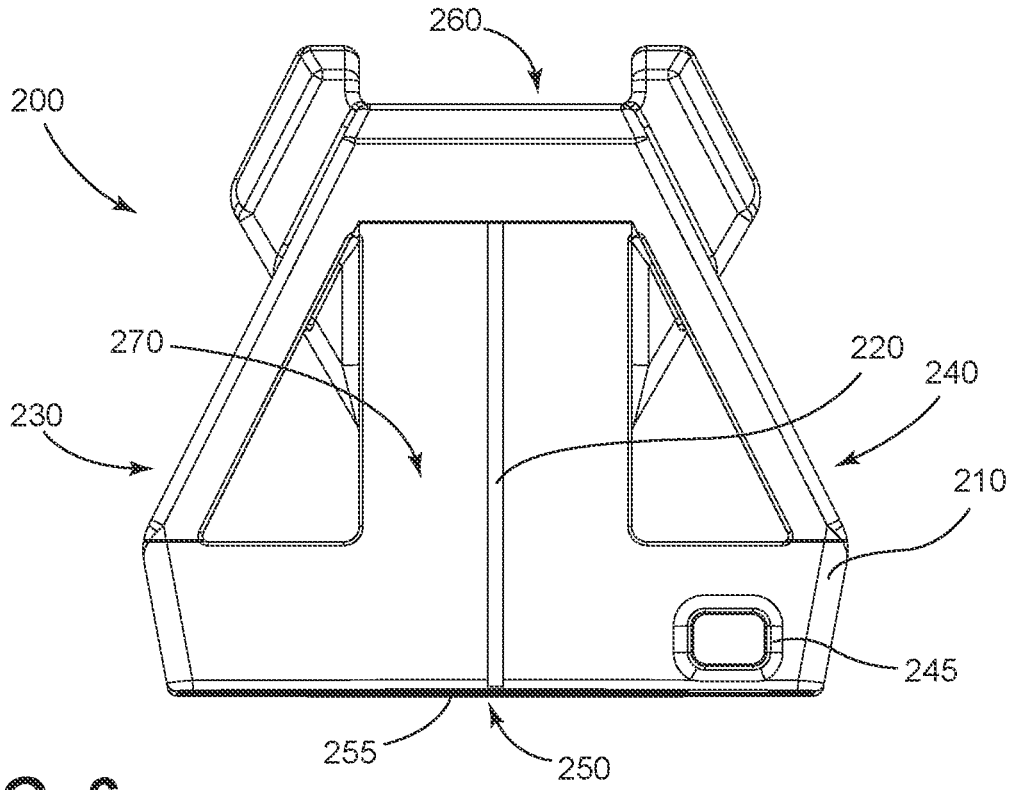
FIG. 6 depicts a top view of the golf club head of FIG. 2.
Figure 7:
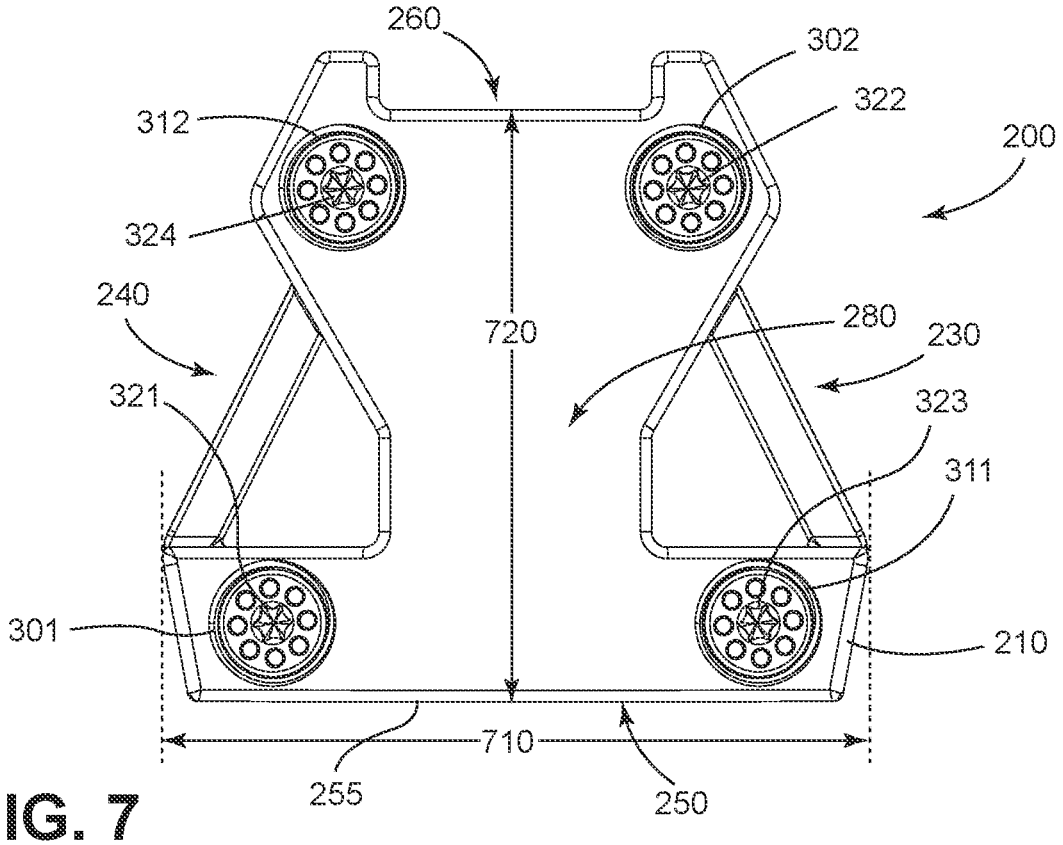
FIG. 7 depicts a bottom view of the golf club head of FIG. 2.
Figure 8:
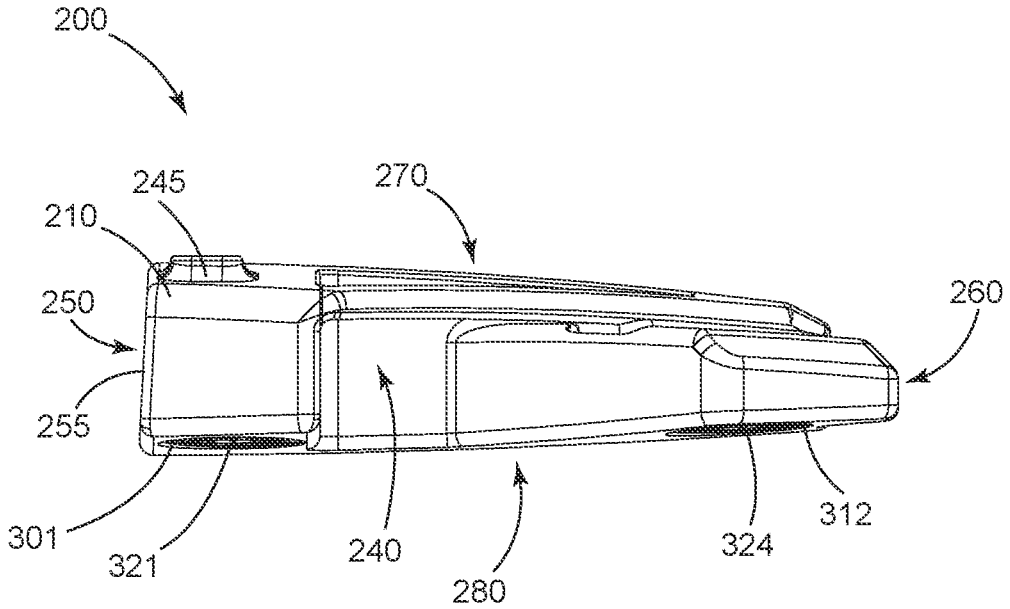
FIG. 8 depicts a left side view of the golf club head of FIG. 2.
Figure 9:
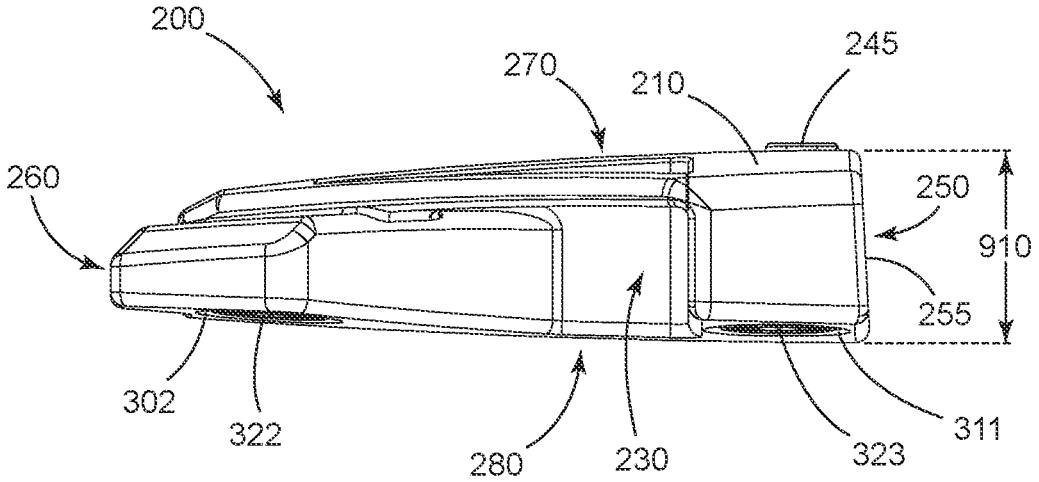
FIG. 9 depicts a right side view of the golf club head of FIG. 2.
Figure 10:
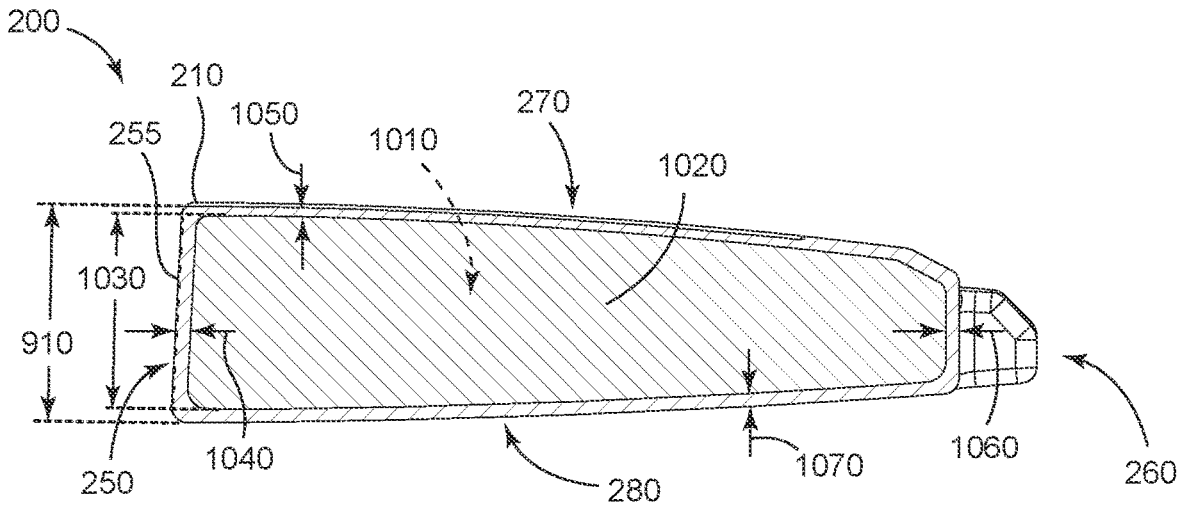
FIG. 10 depicts a cross-sectional view of the golf club head of FIG. 2 taken at lines 10-10 of FIG. 5.
Figure 11:
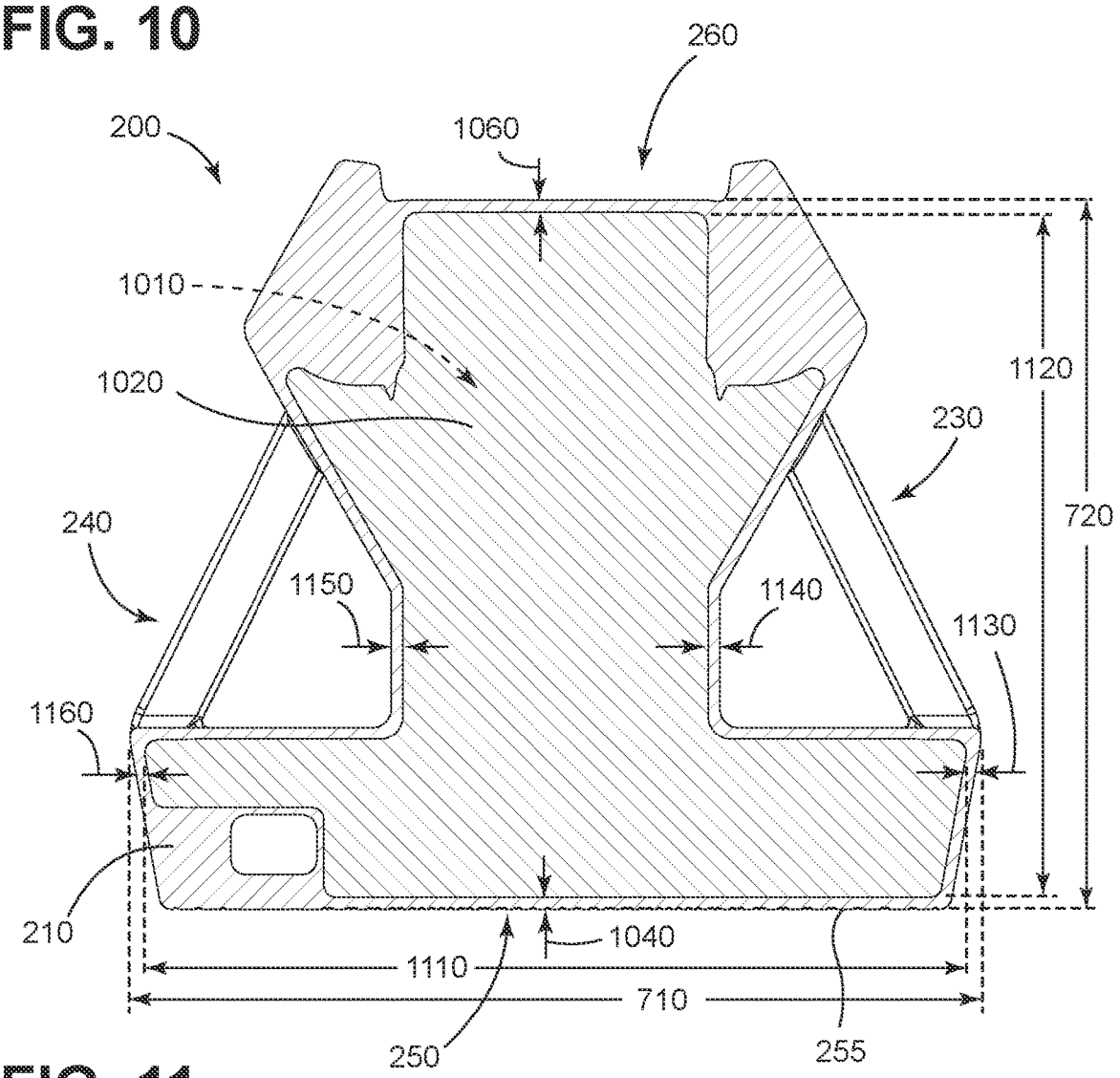
FIG. 11 depicts a cross-sectional view of the golf club head of FIG. 2 taken at lines 11-11 of FIG. 5.
Figure 12:
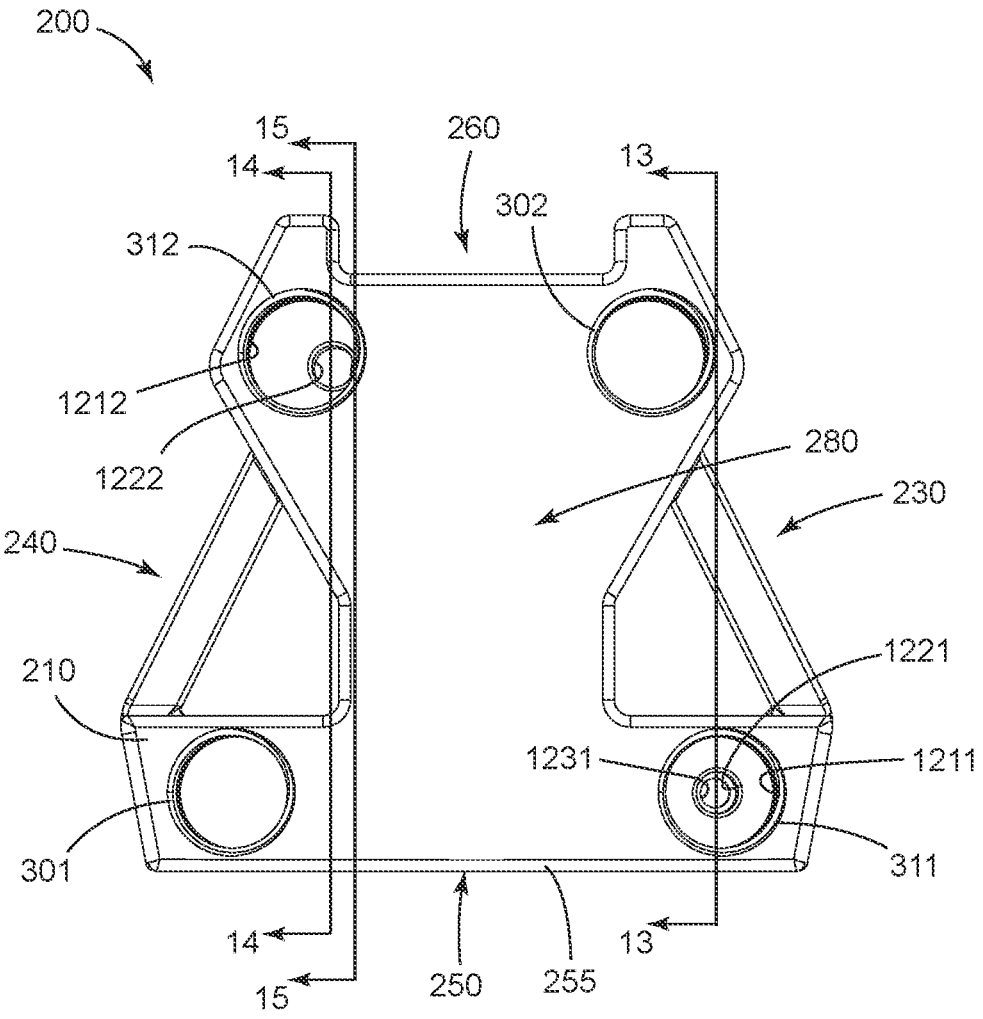
FIG. 12 depicts a bottom view of a body portion of the golf club head of FIG. 2.
Figure 13:
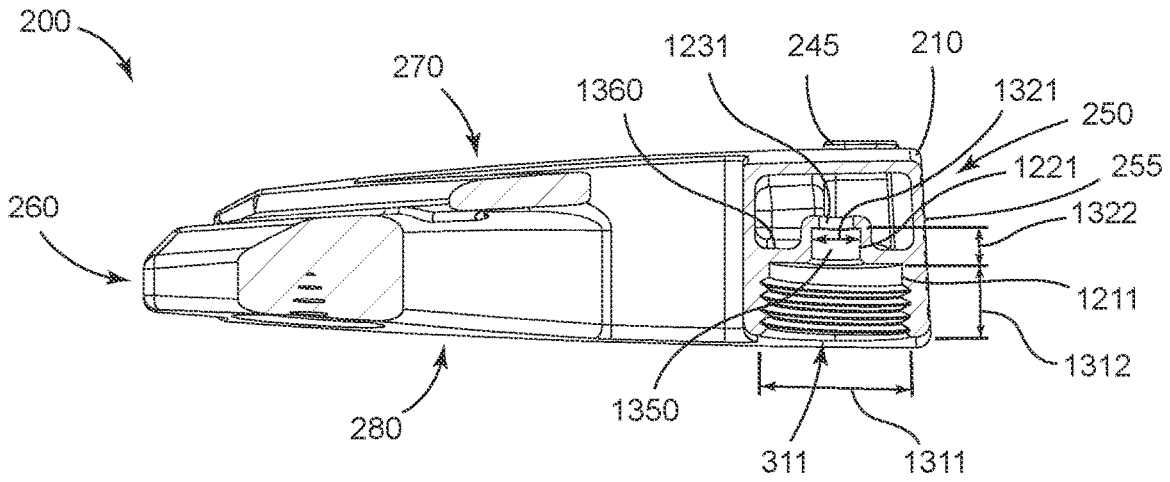
FIG. 13 depicts a cross-sectional view of the body portion of FIG. 12 taken at lines 13-13 of FIG. 12.
Figure 14:
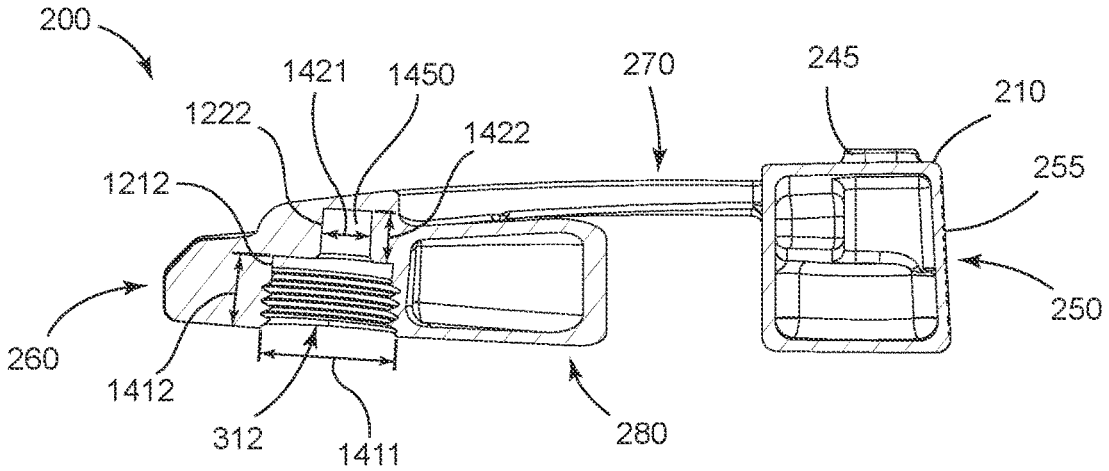
FIG. 14 depicts a cross-sectional view of the body portion of FIG. 12 taken at lines 14-14 of FIG. 12.
Figure 15:
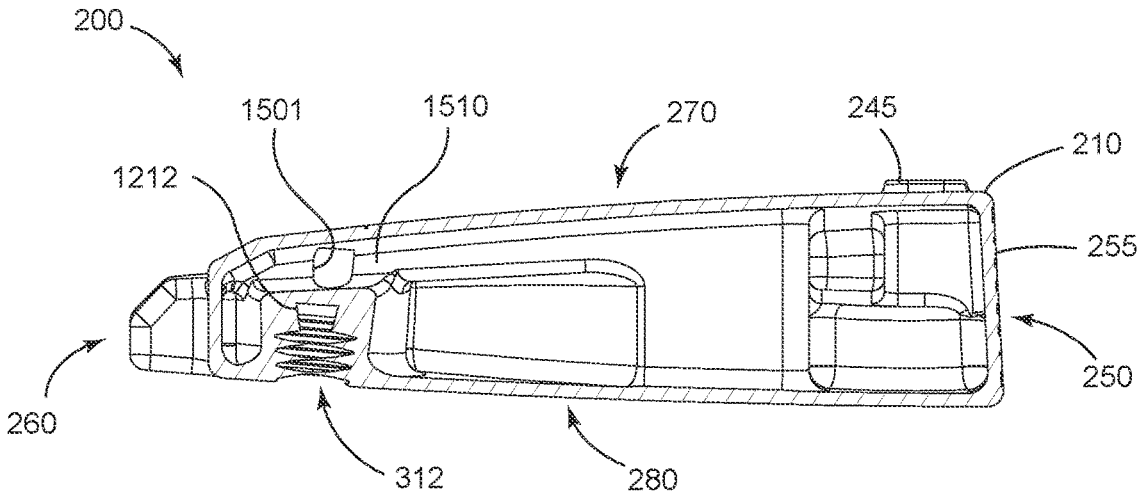
FIG. 15 depicts a cross-sectional view of the body portion of FIG. 12 taken at lines 15-15 of FIG. 12.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard.

In the example of FIG. 1, a golf club 100 may include a golf club head 110, a shaft 120, a grip 130, and a hosel portion 140. The shaft 120 may have a tip end portion 122 and a butt end portion 124. The butt end portion 124 of the shaft 120 may be coupled to the grip 130 and the tip end portion 122 of the shaft 120 may be coupled to the hosel portion 140. The hosel portion 140 may be coupled to the golf club head 110 (e.g., via a hosel bore) or may be integral with the golf club head 110. The shaft 120 may be formed from a metal material, a composite material, or any other suitable material or combination of materials. The grip 130 may be formed from a rubber material, a polymer material, or any other suitable material or combination of materials. The golf club head 110 may generally correspond to any of the golf club heads described below. The apparatus, methods, and articles of manufacture described herein are not limited in this regard.

In FIGS. 2-15, an example golf club head 200 may include a body portion 210 having a visual guide portion 220, a toe portion 230, a heel portion 240, a front portion 250, a rear portion 260, a top portion 270, and a sole portion 280. The body portion 210 may be manufactured via various manufacturing methods and/or processes (e.g., a casting process, a forging process, a milling process, a cutting process, a grinding process, a welding process, a combination thereof, etc.). The body portion 210 may be partially or entirely formed from an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 210 may be partially or entirely formed from a non-metal material (e.g., composite, plastic, etc.). The golf club head 200 may be a putter-type golf club head (e.g., a blade-type putter, a mid-mallet-type putter, a mallet-type putter, etc.). Based on the type of putter as mentioned above, the body portion 210 may be at least 200 grams. The apparatus, methods, and articles of manufacture described herein are not limited in this regard.

The toe portion 230 and the heel portion 240 may be on opposite ends of the body portion 210. The heel portion 240 may include a bore 245 configured to engage with a hosel portion (e.g., hosel portion 140; FIG. 1). Alternatively, the hosel portion may be an integral portion of the body portion 210 or omitted altogether such that a shaft (e.g., shaft 120; FIG. 1) directly couples with the body portion 210 via a shaft bore (not shown), for example. The toe portion 230 and the heel portion 240 may define a lateral length 710 of the body portion 210. In the present example, the lateral length 710 of the body portion 210 may correspond to a side-to-side distance between a toe-most extent and a heel-most extent of the body portion 210. The front portion 250 and the rear portion 260 may be on opposite ends of the body portion 210. The front portion 250 may include a face portion 255 (e.g., a strike face). The face portion 255 may be an integral portion of the body portion 210. Alternatively, the face portion 255 may be a separate piece or an insert coupled to the body portion 210 via various manufacturing methods and/or processes (e.g., a bonding process, a welding process, a brazing process, a mechanical locking method, a mechanical fastening method, any combination thereof, or other suitable types of manufacturing methods and/or processes). The face portion 255 may be associated with a loft plane that defines the loft angle of the golf club head 200. The face portion 255 may define one or more grooves therein to product a variety of face patterns for striking a golf ball. The front portion 250 and the rear portion 260 may define a center longitudinal length 720 of the body portion 210. In the present example, the center longitudinal length 720 of the body portion 210 may correspond to a centerline distance between a forward-most extent and a rearward-most extent of the body portion 210. The top portion 270 and the sole portion 280 may be on opposite ends of the body portion 210 and may define a height 910 of the body portion 210. In the present example, the height 910 of the body portion 210 may correspond to a top-to-bottom distance between an upper-most extent and a lower-most extent of the body portion 210. The apparatus, methods, and articles of manufacture described herein are not limited in this regard.

The visual guide portion 220 may be located at the top portion 270. The visual guide portion 220 may include a solid line portion, a dashed line portion, a dotted line portion, or any combination thereof. In one example, the visual guide portion 220 may be a solid line portion. The visual guide portion 220 may include a colored line portion, a raised line portion, a recessed line portion, a laser-etched line portion, or any combination thereof. The visual guide portion 220 may be a different color than the body portion 210. For example, the visual guide portion 220 may be a white color whereas the body portion 210 may be a black color (e.g., a black-nickel chrome). The apparatus, methods, and articles of manufacture described herein are not limited in this regard.

The body portion 210 may be hollow to include an interior cavity 1010 partially or entirely filled with a filler material 1020. The interior cavity 1010 may extend between the toe portion 230 and the heel portion 240, between the front portion 250 and the rear portion 260, and between the top portion 270 and the sole portion 280. In one example, the interior cavity 1010 may define a volume that is greater than or equal to 60% of a total volume of the body portion 210. In another example, the interior cavity 1010 may define a volume that is greater than or equal to 70% of a total volume of the body portion 210. In yet another example, the interior cavity 1010 may define a volume that is greater than or equal to 80% of a total volume of the body portion 210. The interior cavity 1010 may take on a variety of shapes and sizes based on the dimensions of the body portion 210. In one example, the interior cavity 1010 may have a lateral length 1110 that is greater than or equal to 80% of the lateral length 710 of the body portion 210. In another example, the interior cavity 1010 may have a lateral length 1110 that is greater than or equal to 85% of the lateral length 710 of the body portion 210. In yet another example, the interior cavity 1010 may have a lateral length 1110 that is greater than or equal to 90% of the lateral length 710 of the body portion 210. In the present example, the lateral length 1110 of the interior cavity 1010 may correspond to a side-to-side distance between a toe-most extent and a heel-most extent of the interior cavity 1010. In one example, the interior cavity 1010 may have a center longitudinal length 1120 that is greater than or equal to 80% of the center longitudinal length 720 of the body portion 210. In another example, the interior cavity 1010 may have a center longitudinal length 1120 that is greater than or equal to 85% of the center longitudinal length 720 of the body portion 210. In yet another example, the interior cavity 1010 may have a center longitudinal length 1120 that is greater than or equal to 90% of the center longitudinal length 720 of the body portion 210. In the present example, the center longitudinal length 1120 of the interior cavity 1010 may correspond to a centerline distance between a forward-most extent and a rearward-most extent of the interior cavity 1010. In one example, the interior cavity 1010 may have a height 1030 that is greater than or equal to 80% of the height 910 of the body portion 210. In another example, the interior cavity 1010 may have a height 1030 that is greater than or equal to 85% of the height 910 of the body portion 210. In yet another example, the interior cavity 1010 may have a height 1030 that is greater than or equal to 90% of the height 910 of the body portion 210. In the present example, the height 910 of the interior cavity 1010 may correspond to a top-to-bottom distance between an upper-most extent and a lower-most extent of the interior cavity 1010. Accordingly, the body portion 210 may be thin-walled or substantially thin-walled with uniform or variable wall thickness (e.g., shown as wall thicknesses 1040, 1050, 1060, 1070, 1130, 1140, 1150, and 1160). In one example, the wall thickness at one or more of the toe portion 230, the heel portion 240, the front portion 250, the rear portion 260, the top portion 270, and the sole portion 280 may be less than or equal to 0.060 inch. The apparatus, methods, and articles of manufacture described herein are not limited in this regard.

The filler material 1020 may be a polymer material. In one example, the filler material 1020 may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, the filler material 1020 may be one or more thermoset polymers having bonding properties (e.g., one or more adhesive or epoxy materials). The filler material 1020 may also absorb shock, isolate vibration, and/or dampen noise when the golf club head 200 strikes a golf ball. Further, the filler material 1020 may be an epoxy material that may be flexible or slightly flexible when cured. In another example, the filler material 1020 may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minnesota. In another example, the filler material 1020 may include 3M™ Scotch-Weld™ Epoxy Adhesive DP100 Plus Clear. In another example, the filler material 1020 may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Michigan. In another example, the filler material 1020 may be LOCTITE® materials manufactured by Henkel Corporation, Rocky Hill, Connecticut. In another example, the filler material 1020 may be a polymer material such as an ethylene copolymer material that may absorb shock, isolate vibration, and/or dampen noise when a golf club head strikes a golf ball via the face portion. In another example, the filler material 1020 may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with DuPont™ High-Performance Resin (HPF) family of materials (e.g., DuPont™ HPF AD 1172, DuPont™ HPF AD1035, DuPont® HPF 1000 and DuPont™ HPF 2000), which are manufactured by E.I. du Pont de Nemours and Company of Wilmington, Delaware. The DuPont™ HPF family of ethylene copolymers are injection moldable and may be used with conventional injection molding equipment and molds, provide low compression, and provide high resilience, i.e., relatively high coefficient of restitution (COR). In another example, the filler material 1020 may be formed from one or more metals or metal alloys, such as aluminum, copper, zinc, and/or titanium. A filler material not specifically described in detail herein may include one or more similar or different types of materials described herein. The apparatus, methods, and articles of manufacture described herein are not limited in this regard.

The filler material 1020 may provide vibration dampening and/or sound dampening (e.g., consistent and/or pleasing sound and feel when the golf club head 200 strikes a golf ball as perceived by an individual using the golf club head 200, provide structural support for the face portion 255, and/or improve ball travel distance, ball speed, and/or ball dispersion). The filler material 1020 may provide the properties and characteristics described herein whereas the mass of the filler material 1020 relative to the mass of the body portion 210 may optimally affect the mass, mass distribution, center of gravity (CG), moment of inertia (MOI) characteristics, structural integrity and/or other static and/or dynamic characteristics of the golf club head 200. The apparatus, methods, and articles of manufacture described herein are not limited in this regard.

The body portion 210 may include a plurality of ports generally shown as a first set of ports (e.g., shown as ports 301 and 302, respectively) and a second set of ports (e.g., shown as ports 311 and 312, respectively) peripherally located at the sole portion 280. In the present example, ports 301 and 311 may be located at or proximate the front portion 250 and ports 302 and 312 may be located at or proximate the rear portion 260. Each port of the plurality of ports may be an exterior port configured to receive a weight portion of a plurality of weight portions (e.g., shown as weight portions 321, 322, 323, and 324, respectively). The plurality of weight portions may be disk-shaped and may be interchangeable. The plurality of weight portions may have similar or different masses. The plurality of weight portions may be threadedly coupled to the plurality of ports, adhered to the plurality of ports, or otherwise fixedly engaged to the plurality of ports. The plurality of weight portions may be formed from a material that may be similar to or different from a material of the body portion 210 (e.g., materials with different densities) to impact the MOI and/or other mass properties of the golf club head 200. In one example, one or more weight portions of the plurality of weight portions may be formed from a metal material such as, but not limited to, steel, aluminum, titanium, and tungsten. The apparatus, methods, and articles of manufacture described herein are not limited in this regard.

Ports 301 and 302 of the first set of ports may be separate from the interior cavity 1010. Ports 301 and 302 may be cylindrical and may have similar port diameters and port depths. Ports 311 and 312 of the second set of ports may communicate with the interior cavity 1010. Port 311 may have a first port section 1211 and a second port section 1221 extending upwardly from the first port section 1211 and connected to the interior cavity 1010 via an opening 1231. Port 312 may have a first port section 1212 and a second port section 1222 extending upwardly from the first port section 1212 and connected to the interior cavity 1010 via an opening 1501. The first port sections 1211 and 1212 may be cylindrical and may each have a port diameter (e.g., shown as port diameter 1311 and port diameter 1411, respectively) and a port depth (e.g., shown as port depth 1312 and port depth 1412, respectively) similar to that of the first set of ports for receiving a weight portion of the plurality of weight portions. The second port sections 1221 and 1222 may be cylindrical and may each have a port diameter (e.g., shown as port diameter 1321 and port diameter 1421, respectively) and a port depth (e.g., shown as port depth 1322 and port depth 1422, respectively) similar or different from that of the first port sections 1211 and 1212, respectively. In one example, the port diameters 1321 and 1421 of the second port sections 1221 and 1222 may be less than the port diameters 1311 and 1411 of the first port sections 1211 and 1212, respectively, and the port depths 1322 and 1422 of the second port sections 1221 and 1222 may be less than the port depths 1312 and 1412 of the first port sections 1211 and 1212, respectively. The second port sections 1221 and 1222 may be coaxially aligned or axially offset with the first port sections 1211 and 1212, respectively. A corresponding plug portion (e.g., shown as plug portion 1350 and plug portion 1450, respectively) may be engaged to each of the second port sections 1221 and 1222 of ports 311 and 312 to prevent the filler material 1020 from escaping the interior cavity 1010 or otherwise restrict access to the interior cavity 1010. The plug portions 1350 and 1450 may be threadedly engaged, adhered, or otherwise fixedly engaged to the corresponding second port sections 1221 and 1222, respectively. In one example, the plug portions 1350 and 1450 may be formed from a polymer material (e.g., plastic, rubber) and may be adhered to the corresponding second port sections 1221 and 1222, respectively. Based on the physical makeup of the interior cavity 1010, the openings 1231 and 1501 may be provided through a base portion 1360 of the interior cavity 1010 or through a side wall portion 1510 of the interior cavity 1010. The interior cavity 1010 may be filled with the filler material 1020 via a fill port (e.g., one of ports 311 and 312) while a relief port (e.g., the other one of ports 311 and 312) may provide relief for air and any excess filler material 1020. In other examples, the fill port and/or the relief port may be provided at other locations of the body portion 210 such as the toe portion 230, the heel portion 240, the front portion 250, the rear portion 260, the top portion 270, or the sole portion 280. In such examples, ports 311 and 312 may be provided separate from the interior cavity 1010 and may be similar in many respects to ports 301 and 302. The apparatus, methods, and articles of manufacture described herein are not limited in this regard.

Figure 16:
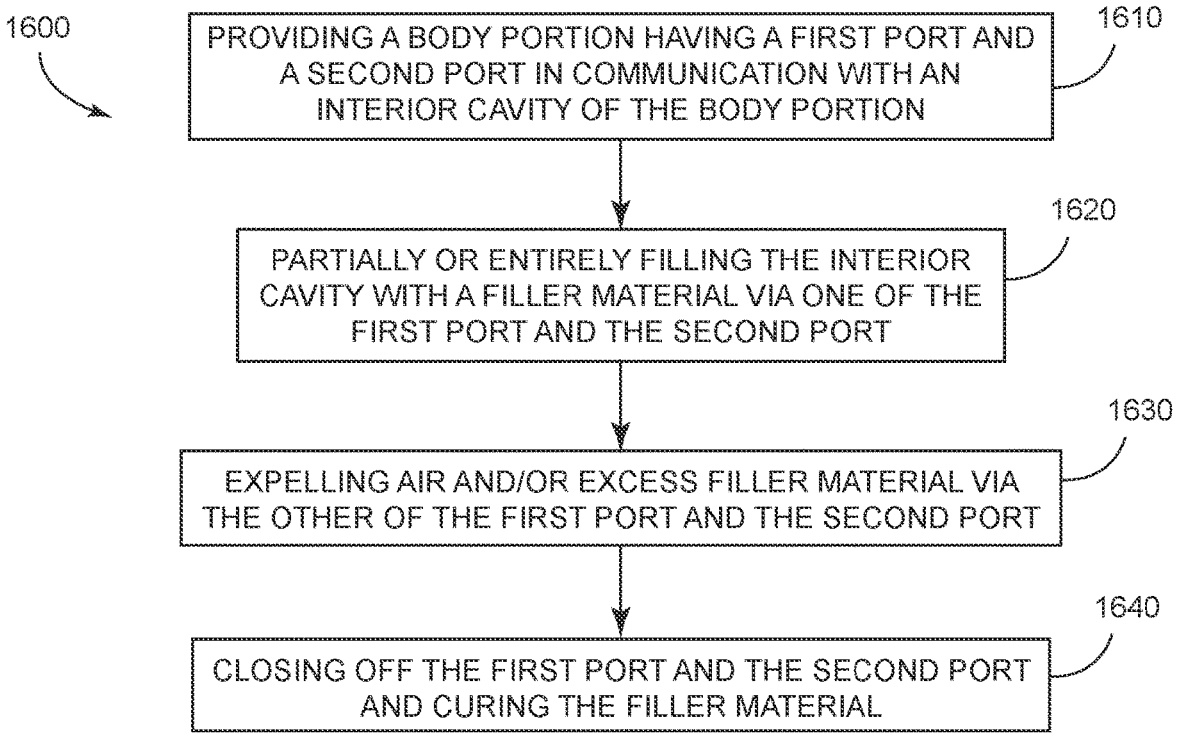
FIG. 16 depicts a method for filling a golf club head according to an embodiment of the apparatus, methods, and articles of manufacturing described herein.
Figure 17:
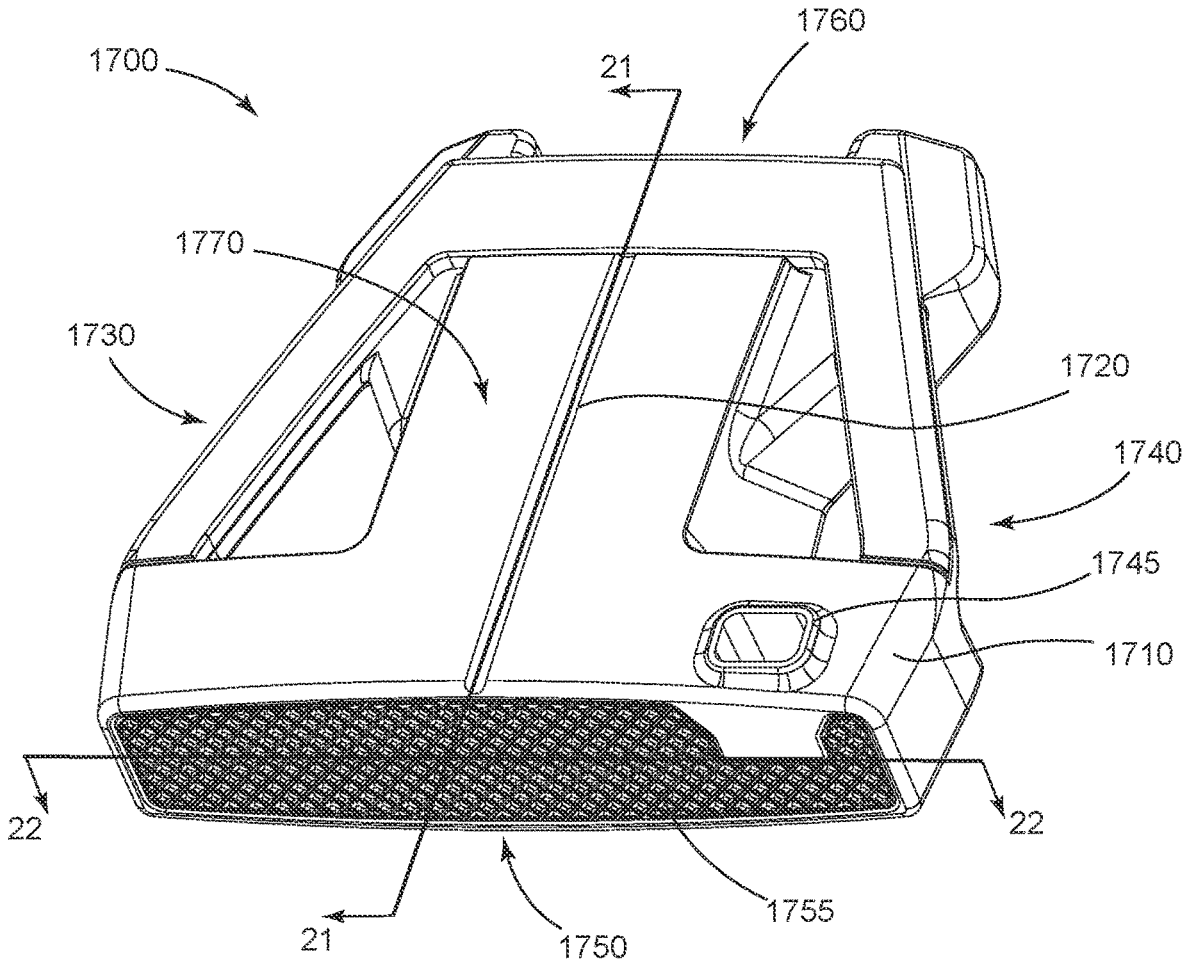
FIG. 17 depicts a front and top perspective view of a golf club head according to an example of the apparatus, methods, and articles of manufacture described herein.
Figure 18:
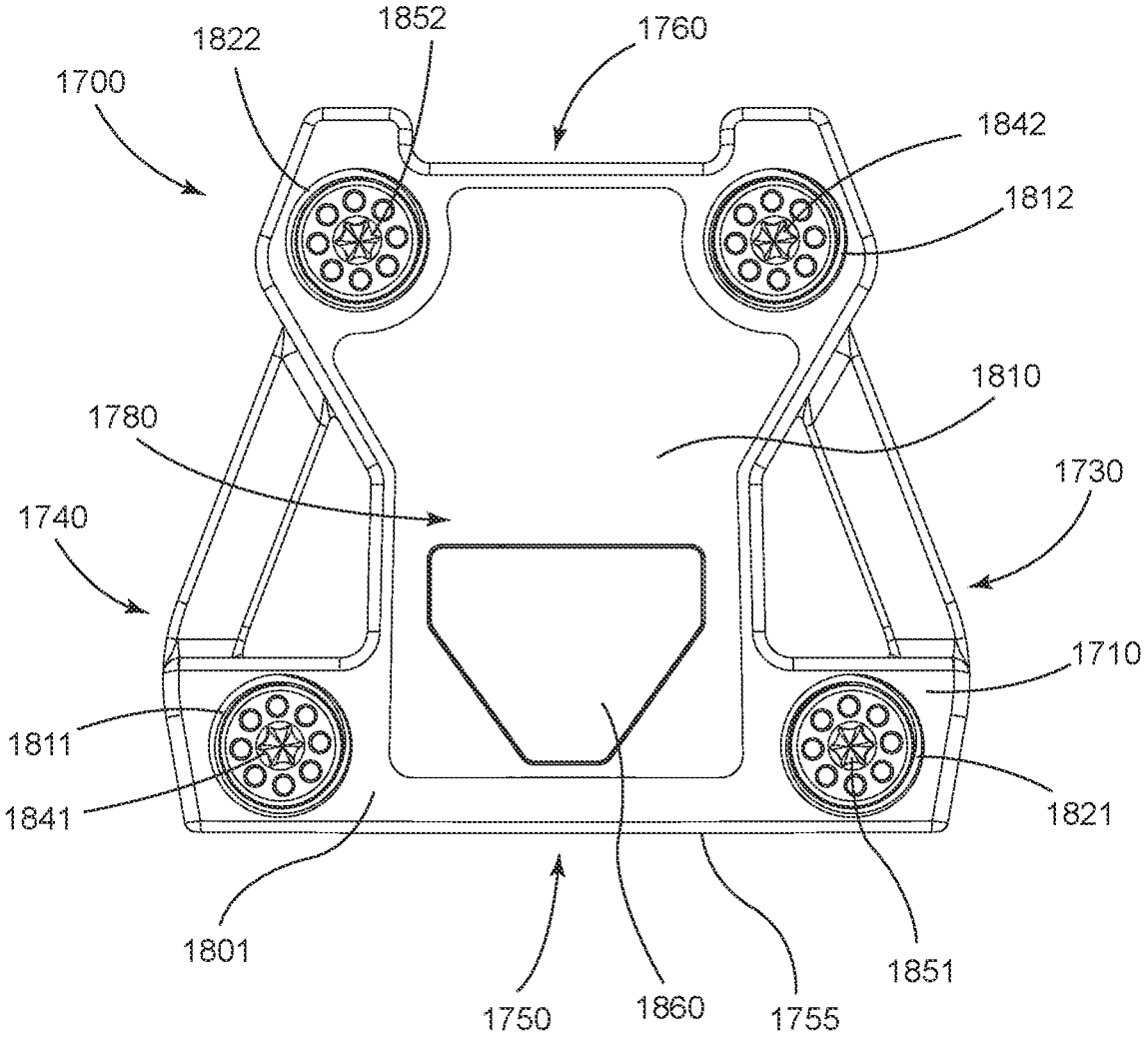
FIG. 18 depicts a bottom view of the golf club head of FIG. 17 configured with a sole plate and a sole plate cover.
Figure 19:
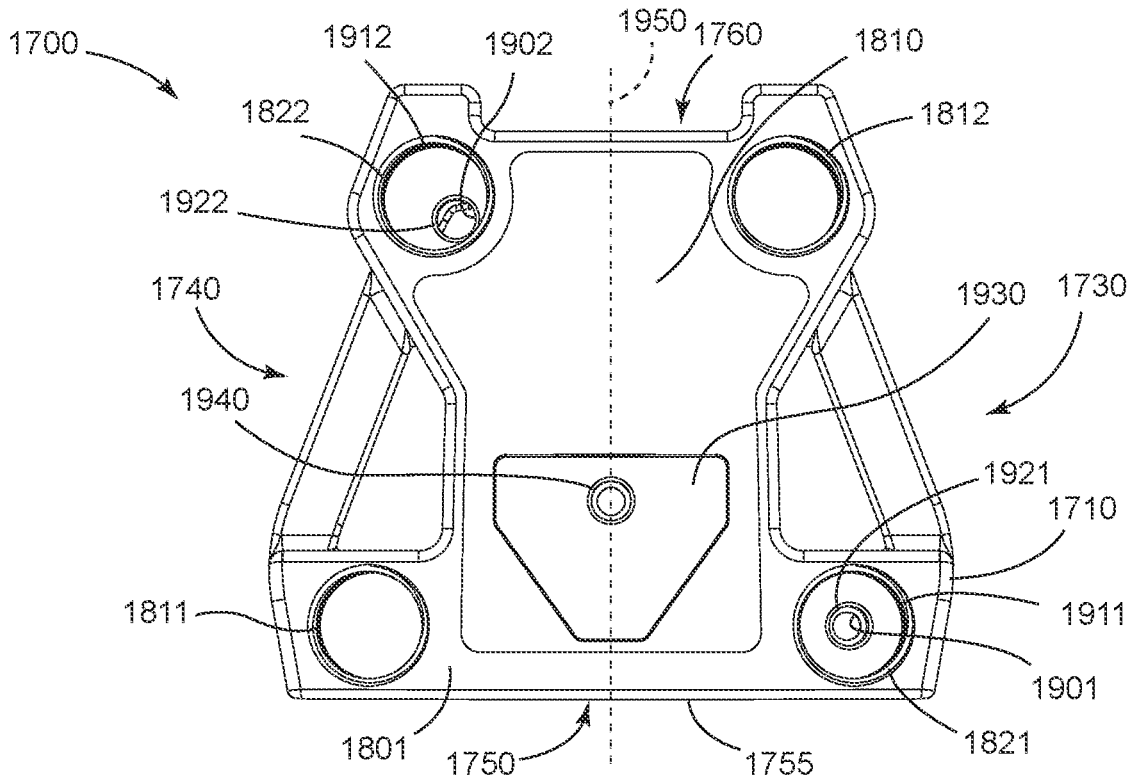
FIG. 19 depicts the golf club head of FIG. 18 with the sole plate cover omitted.
Figure 20:
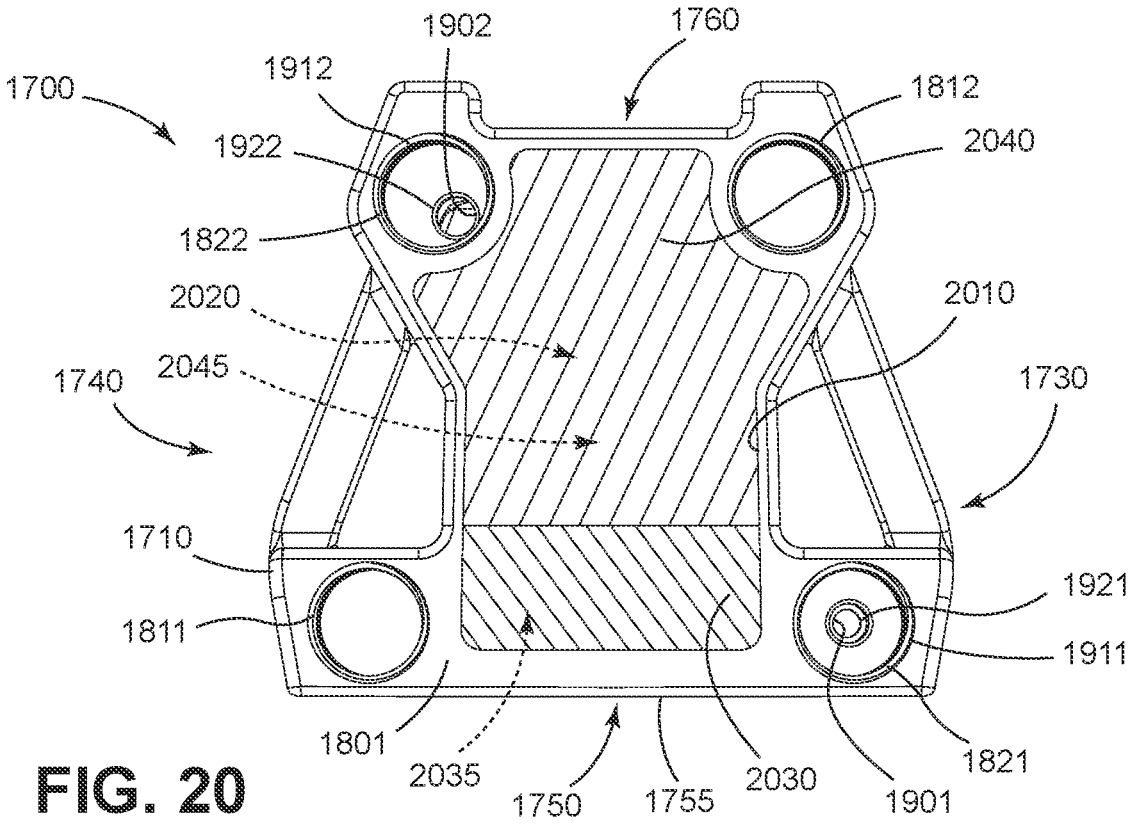
FIG. 20 depicts the golf club head of FIG. 19 with the sole plate omitted.
Figure 21:
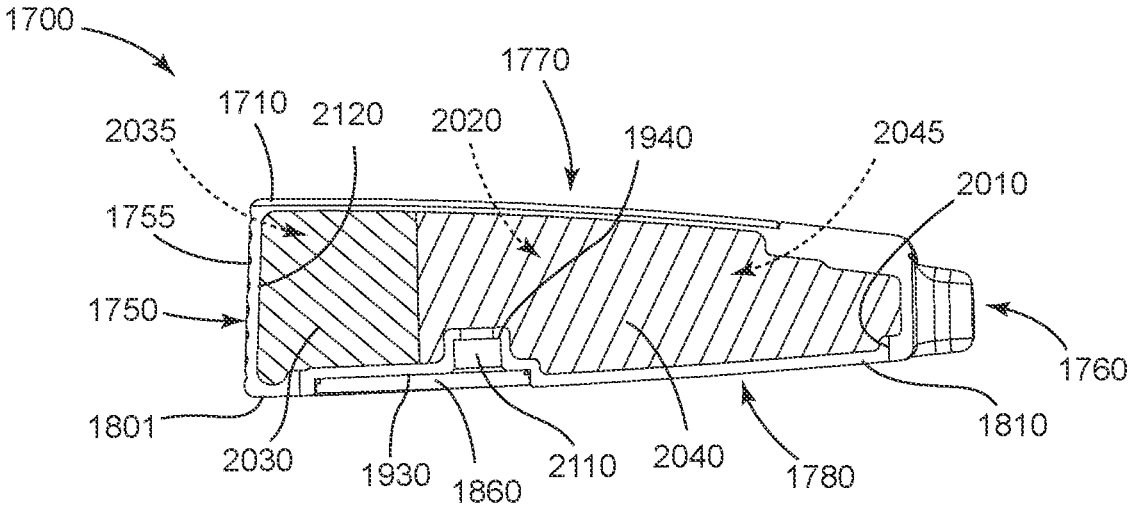
FIG. 21 depicts a cross-sectional view of the golf club head of FIG. 17 taken at lines 21-21 of FIG. 17.
Figure 22:
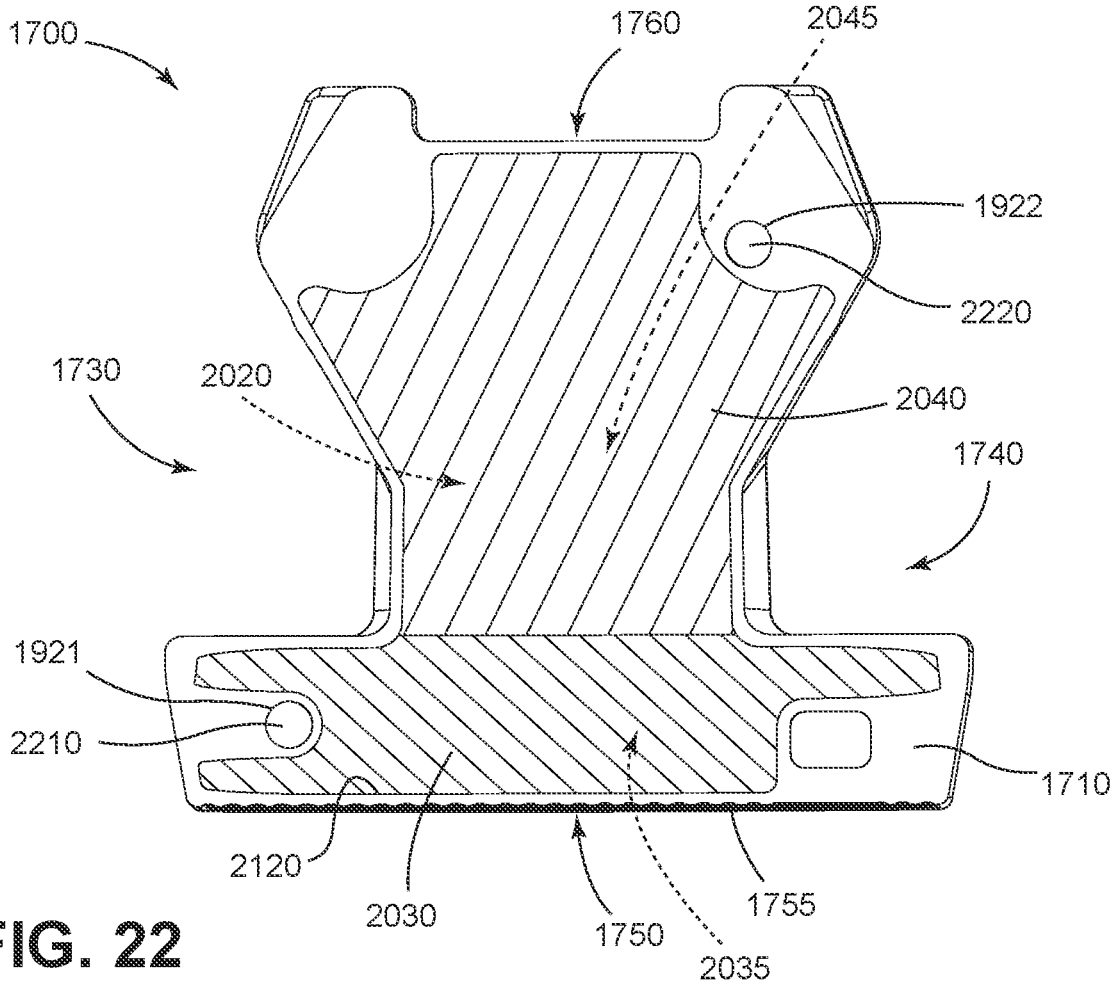
FIG. 22 depicts a cross-sectional view of the golf club head of FIG. 17 taken at lines 22-22 of FIG. 17.

FIG. 16 depicts an example method 1600 for filling a golf club head with continued reference to the example golf club head 200 of FIGS. 2-15 for purposes of understanding. The method 1600 may include providing a body portion 210 having a first port 311 and a second port 312 in communication with an interior cavity 1010 of the body portion 210 (block 1610). The interior cavity 1010 may be partially or entirely filled with a filler material 1020 via one of the first port 311 and the second port 312 (block 1620). The filler material 1020 may be a polymer material that solidifies or foams when cured. Air and/or excess filler material 1020 may be expelled via the other of the first port 311 and the second port 312 (block 1630). Once the interior cavity 1010 has been filled with the filler material 1020, the first port 311 and the second port 312 may be closed off and the filler material 1020 may be cured (block 1640). In one example, the first port 311 and the second port 312 may be closed off using a corresponding plug portion 1350, 1450. Additionally, the first port 311 and the second port 312 may each be configured to receive an interchangeable weight portion 323, 324. The apparatus, methods, and articles of manufacture described herein are not limited in this regard.

In FIGS. 17-22, an example golf club head 1700 may include a body portion 1710 having a visual guide portion 1720, a toe portion 1730, a heel portion 1740, a hosel bore 1745, a front portion 1750, a rear portion 1760, a top portion 1770, and a sole portion 1780. With the exception of the new features described below, the golf club head 1700 may be similar in many respects to the golf club head 200 of FIGS. 2-15. In the illustrated example, the sole portion 1780 may define an opening 2010 that leads into an interior cavity 2020 of the body portion 1710. The sole portion 1780 may include a sole plate 1810 coupled to the body portion 1710 to cover the opening 2010. The body portion 1710 and the sole plate 1810 may be formed from similar or different materials including any suitable materials described herein. In one example, the sole plate 1810 may be formed from a material having a density that is less than a density of the body portion 1710 to increase the MOI of the golf club head 1700. A suitable material for the body portion 1710 may include a tungsten-nickel alloy and a suitable material for the sole plate 1810 may include steel. The body portion 1710 may be formed from a casting process and the sole plate 1810 may be welded to the body portion 1710. Alternatively, the sole plate 1810 may be coupled to the body portion 1710 using mechanical fasteners and/or adhesive. The sole plate 1810 may be configured in a variety of shapes and sizes to impact the MOI and/or other mass properties of the golf club head 1700. The sole plate 1810 may be located between a plurality of ports (e.g., shown as ports 1811, 1812, 1821, and 1822, respectively) peripherally located at the sole portion 1780. The sole plate 1810 may have a surface area defining a substantial portion of a total surface area of the sole portion 1780. In one example, the sole plate 1810 may have a surface area that is greater than or equal to 50% of the total surface area of the sole portion 1780. In another example, the sole plate 1810 may have a surface area that is greater than or equal to 60% of the total surface area of the sole portion 1780. In yet another example, the sole plate 1810 may have a surface area that is greater than or equal to 70% of the total surface area of the sole portion 1780. As described herein, the total surface area of the sole portion 1780 may be defined by a combined surface area of a bottom external surface 1801 of the body portion 1710 and the sole plate 1810. The apparatus, methods, and articles of manufacture described herein are not limited in this regard.

Ports 1811 and 1812 may define a first set of ports separate from the interior cavity 2020 and ports 1821 and 1822 may define a second set of ports in communication with the interior cavity 2020 via a corresponding opening (e.g., shown as opening 1901 and opening 1902). Ports 1811, 1812, 1821, and 1822 may each be configured to receive a weight portion of a plurality of weight portions (e.g., shown as weight portions 1841, 1842, 1851, and 1852, respectively). Ports 1811 and 1812 and corresponding weight portions 1841 and 1842 may be similar in many respects to ports 301 and 302 and corresponding weight portions 321 and 322 of the example golf club head of FIGS. 2-15, respectively. Ports 1821 and 1822 and corresponding weight portions 1851 and 1852 may be similar in many respects to ports 311 and 312 and corresponding weight portions 323 and 324 of the example golf club head 200 of FIGS. 2-15, respectively. Accordingly, ports 1821 and 1822 may each include a corresponding first port section (e.g., shown as first port section 1911 and first port section 1912, respectively) and a corresponding second port section (e.g., shown as second port section 1921 and second port section 1922, respectively). The second port sections 1921 and 1922 may each be configured to receive a corresponding plug portion (e.g., shown as plug portion 2210 and plug portion 2220, respectively) to restrict access to the interior cavity 2020. The plug portions 2210 and 2220 may be similar in many respects to the plug portions 1350 and 1450 of the example golf club head 200 of FIGS. 2-15, respectively. The apparatus, methods, and articles of manufacture described herein are not limited in this regard.

The sole plate 1810 may include a depression 1930 having a through-port 1940 extending into an interior cavity 2020 of the body portion 1710 and in communication with the interior cavity 2020. The interior cavity 2020 may be similar in many respects to the interior cavity 1010 of the example golf club head 200 of FIGS. 2-15. The depression 1930 and/or the through-port 1940 may have a variety of shapes and sizes. In the present example, the depression 1930 and the through-port 1940 may be bisected by or be symmetrical relative to a longitudinal centerline plane 1950 of the body portion 1710. In one example, the depression 1930 and/or the through-port 1940 may be located closer to the front portion 1750 than the rear portion 1760. In another example, the depression 1930 and/or the through-port 1940 may be located closer to the rear portion 1760 than the front portion 1750. In yet another example, the depression 1930 and/or the through-port 1940 may be located equidistant to the front portion 1750 and the rear portion 1760. The location of the depression 1930 and/or the through-port 1940 may be determined based on a particular fill process by which the interior cavity 2020 is partially or entirely filled with two or more filler materials exemplarily shown as a first filler material 2030 and a second filler material 2040. In one example, the through-port 1940 may be disposed behind the first filler material 2030 and may be at least partially encased by the second filler material 2040. A plug portion 2110 may be coupled to the through-port 1940 to restrict access to the interior cavity 2020 via the through-port 1940. The plug portion 2110 may be similar in many respects any of the plug portions described herein. The apparatus, methods, and articles of manufacture described herein are not limited in this regard.

The first filler material 2030 may partially or entirely fill a first interior cavity space 2035 behind a face portion 1755 of golf club head 1700. The first filler material 2030 may be provided as a lightweight solid face backing material abutting a rear surface 2120 of the face portion 1755 to increase the MOI of the golf club head 1700. In one example, the first filler material 2030 may be formed from a polymer material that solidifies when cured and may be bonded to the rear surface 2120 of the face portion 1755 to structurally reinforce the face portion 1755. The first filler material 2030 may have a hardness rating that falls within the Shore D durometer hardness scale and may be flexible or slightly flexible to enable the face portion 1755 to be made thinner in order to improve elasticity without sacrificing durability. A suitable first filler material 2030 may include 3M™ Scotch-Weld™ Epoxy Adhesive DP100 Plus Clear. In addition to increasing the MOI of the golf club head 1700, the first filler material 2030 may improve other performance properties such as, but not limited to, vibration dampening, sound dampening, feel, ball travel distance, ball speed, and/or ball dispersion. The second filler material 2040 may be located behind the first filler material 2030 and may partially or entirely fill a second interior cavity space 2045 corresponding to a remaining space of the interior cavity 2020 that is unoccupied by the first filler material 2030. The second filler material 2040 may be in abutting contact with the first filler material 2030 and may also be formed from a lightweight material having a density that is less than a density of the first filler material 2030 to further increase the MOI of the golf club head 1700. The second filler material 2040 may have a lower hardness than the hardness of the first filler material 2030. The second filler material 2040 may have a hardness rating that falls within one of a Shore D durometer hardness scale, a Shore A durometer hardness scale, an Asker C durometer hardness scale, an Asker F durometer hardness scale, an Asker JA durometer hardness scale, an Asker B durometer hardness scale, an Asker C2 durometer hardness scale, an Asker CS durometer hardness scale, and an Asker E durometer hardness scale. In one example, the second filler material 2040 may be formed from a polymer material that foams when cured. One suitable second filler material 2040 may include a urethane foam having a hardness rating that falls within the Asker F durometer hardness scale. In addition to increasing the MOI of the golf club head 1700, the second filler material 2040 may improve other performance properties such as, but not limited to, vibration dampening, sound dampening, feel, ball travel distance, ball speed, and/or ball dispersion. In another example, the first filler material 2030 and/or the second filler material 2040 may be constructed from any of the filler materials described herein. The apparatus, methods, and articles of manufacture described herein are not limited in this regard.

The first interior cavity space 2035 occupied by the first filler material 2030 may have a volume that is less than a volume of the second interior cavity space 2045 occupied by the second filler material 2040. In another example, the volume of the first interior cavity space 2035 may be the same or about the same as the volume of the second interior cavity space 2045. In yet another example, the volume of the first interior cavity space 2035 may be greater than the volume of the second interior cavity space 2045. The particular volume of the first interior cavity space 2035 and the second interior cavity space 2045 along with the amount of first filler material 2030 and the second filler material 2040 may be determined based on any of the performance and/or mass properties described herein. The apparatus, methods, and articles of manufacture described herein are not limited in this regard.

A sole plate cover 1860 may be coupled to the depression 1930 to close off the through-port 1940. Additionally, the sole plate cover 1860 may conceal the depression 1930 and the through-port 1940. The sole plate cover 1860 may be configured to complement the depression 1930 and may be received in the depression 1930 such that the sole plate cover 1860 is flush or substantially flush with the sole plate 1810. The sole plate cover 1860 may be formed from any suitable material described herein and may be similar or different from a material of the body portion 1710 and the sole plate 1810 to impact the MOI and/or other mass properties of the golf club head 1700. In one example, the sole plate cover 1860 may be formed from a material having a density that is less than the density of the body portion 1710 and the sole plate 1810 to increase the MOI of the golf club head 1700. A suitable material for the sole plate cover 1860 may include a lightweight metal material (e.g., nickel) produced by an electroforming process. The sole plate cover 1860 may be coupled to the depression 1930 using a mechanical fastener, adhesive, and the like. The apparatus, methods, and articles of manufacture described herein are not limited in this regard.

Figure 23:
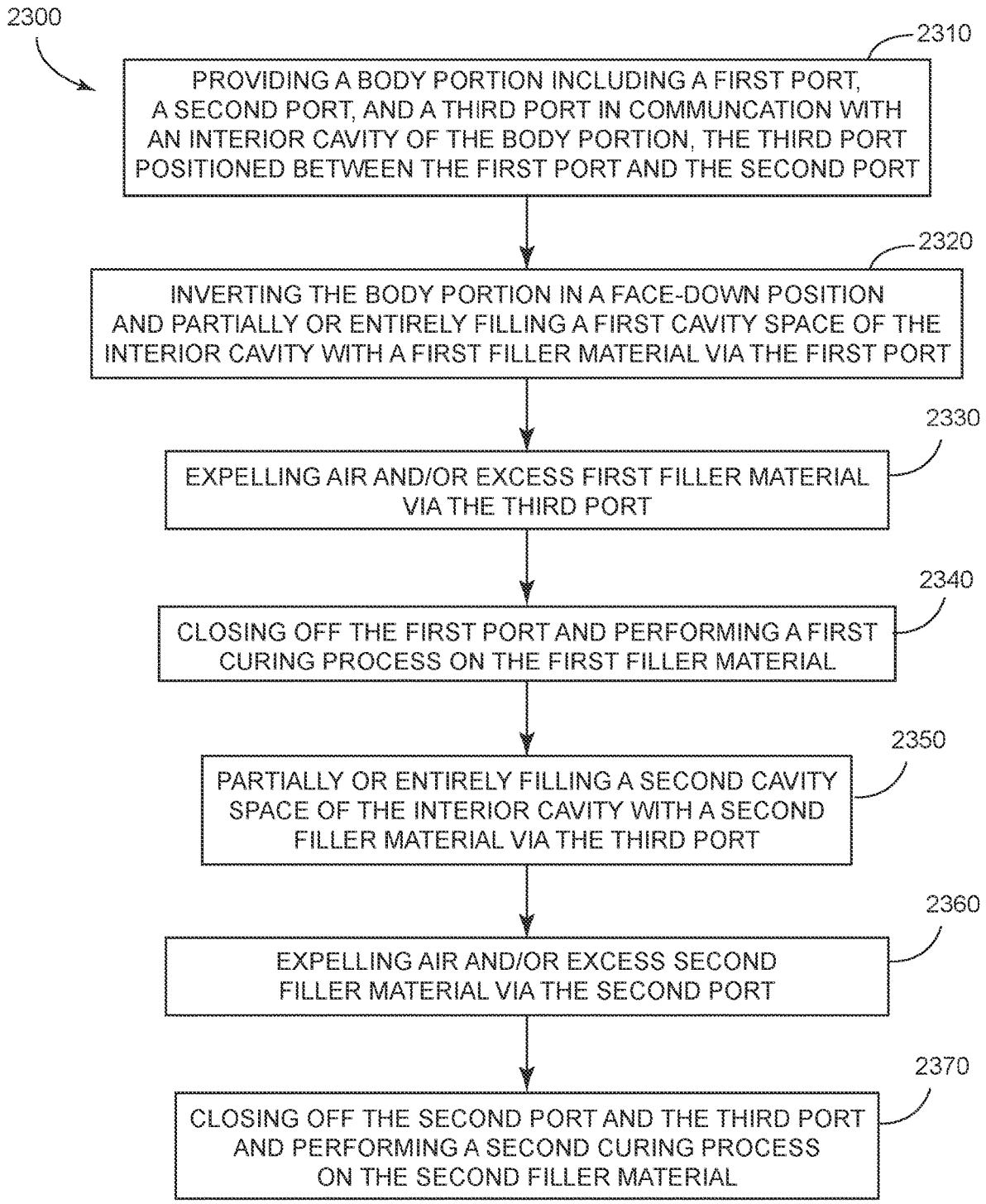
FIG. 23 depicts a method for filling a golf club head according to an embodiment of the apparatus, methods, and articles of manufacturing described herein.

FIG. 23 depicts an example method 2300 for filling a golf club head with continued reference to the golf club head 1700 of FIGS. 17-22 for purposes of understanding. The method 2300 may include providing a body portion 1710 including a first port 1821, a second port 1822, and a third port (e.g., through-port 1940) in communication with an interior cavity 2020 of the body portion 1710 (block 2310). In one example, the first port 1821, the second port 1822, and the through-port 1940 may be disposed at a sole portion 1780 of the body portion 1710. The first port 1821 may be disposed at or proximate a front portion 1750 of the body portion 1710 and the second port 1822 may be disposed at or proximate a rear portion 1760 of the body portion 1710. The third port or through-port 1940 may be disposed between the first port 1821 and the second port 1822. The body portion 1710 may be inverted in a face-down position and a first interior cavity space 2035 of the interior cavity 2020 may be partially or entirely filled with a first filler material 2030 via the first port 1821 (block 2320). Alternatively, the first interior cavity space 2035 may be filled with the first filler material 2030 by positioning the body portion 1710 at any orientation (e.g., upside down orientation). In one example, the first filler material 2030 may be formed from a polymer material that solidifies when cured. By inverting the body portion 1710 in the face-down position, an improved bond may be achieved between the first filler material 2030 and a rear surface 2120 of a face portion 1755 of the golf club head 1700. During the filling of the first interior cavity space 2035 with the first filler material 2030, the third port (e.g., through-port 1940) may expel air and/or excess first filler material 2030 (block 2330). Once the fill process for the first filler material 2030 is complete, the first port 1821 may be closed off and a first curing process may be performed on the first filler material 2030 (block 2340). The first port 1821 may be closed off using a plug portion 2210 as described herein. The first filler material 2030 may serve as a face backing structure that reinforces the face portion 1755 of the golf club head 1700 while increasing the MOI of the golf club head 1700. After the first filler material 2030 is cured, a second interior cavity space 2045 of the interior cavity 2020 may be partially or entirely filled with a second filler material 2040 via the third port (through-port 1940) (block 2350). In one example, the second filler material 2040 may be formed from a polymer material that foams when cured. During the filling of the second interior cavity space 2045 with the second filler material 2040, the second port 1822 may expel air and/or excess second filler material 2040 (block 2360). Once the fill process for the second filler material 2040 is complete, the second port 1822 and the third port (e.g., through-port 1940) may be closed off and a second curing process may be performed on the second filler material 2040 (block 2370). The second port 1822 may be closed off using a plug portion 2220 and the third port (e.g., through-port 1940) may be closed off using a plug portion 2110 as described herein. The second filler material 2040 may have a density that is less than a density of the first filler material 2030 to further increase the MOI of the golf club head 1700. The apparatus, methods, and articles of manufacture described herein are not limited in this regard.

Figure 24:
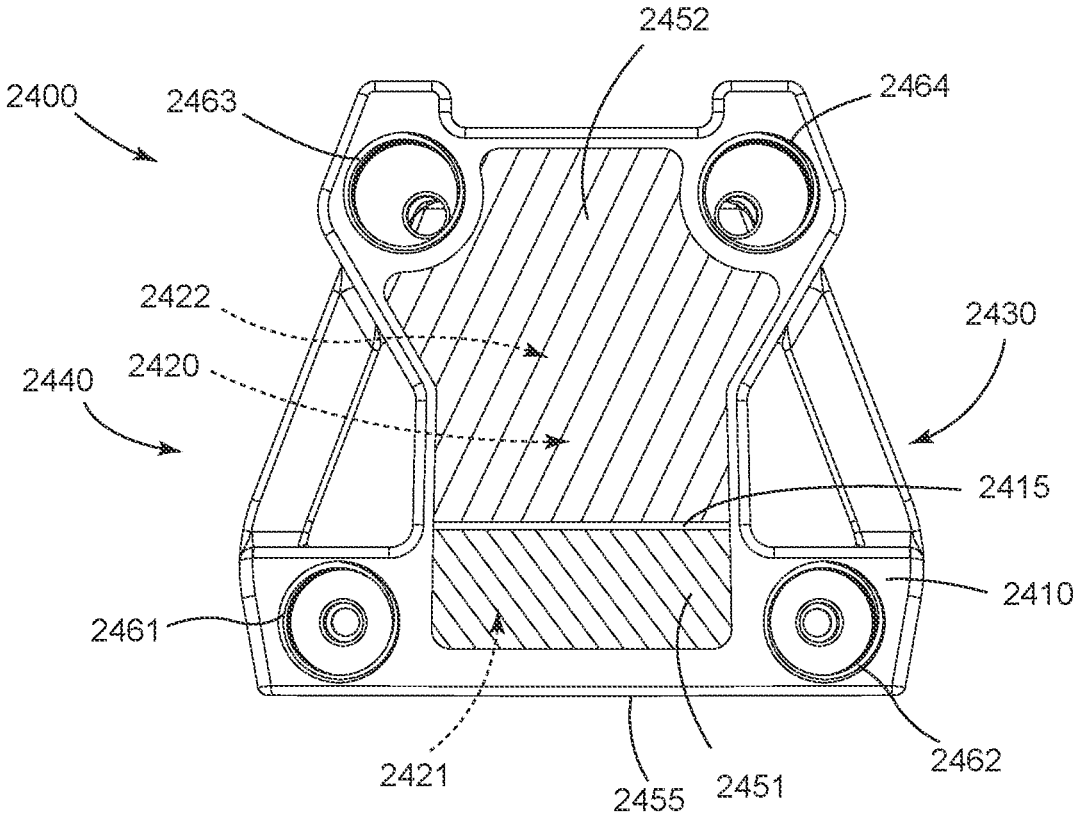
FIG. 24 depicts a bottom view of a golf club head according to an embodiment of the apparatus, methods, and articles of manufacturing described herein.

FIG. 24 depicts a bottom view of an example golf club head 2400. With the exception of the new features described below, the golf club head 2400 may be similar in many respects to the golf club head 1700 shown in FIG. 20. The golf club head 2400 may include a body portion 2410 having an interior cavity 2420 separated into two or more interior cavity spaces (e.g., shown as a first interior cavity space 2421 and a second interior cavity space 2422) by one or more partition portions (e.g., shown as partition portion 2415) integral with the body portion 2410 or separately provided and coupled to the body portion 2410. In the illustrated example, the partition portion 2415 may extend laterally between a toe portion 2430 and a heel portion 2440 of the body portion 2410. Accordingly, the partition portion 2415 may separate the interior cavity 2420 into a front hemisphere and a rear hemisphere of similar or different proportions. That is, the first interior cavity space 2421 may have a volume that is less than, about equal to, or larger than a volume of the second interior cavity space 2422. In another example, the partition portion 2415 may be configured to separate the interior cavity 2420 into a toe-side hemisphere and a heel-side hemisphere of similar or different proportions. The first interior cavity space 2421 may be partially or entirely filled by a first filler material 2451 and the second interior cavity space 2422 may be partially or entirely filled by a second filler material 2452. The first filler material 2451 and the second filler material 2452 may be different from one another and may include any of the filler materials described herein. The first interior cavity space 2421 may be filled with the first filler material 2451 via one of a first port 2461 and a second port 2462 while the other of the first port 2461 and the second port 2462 may provide relief for air and any excess first filler material 2451. Similarly, the second interior cavity space 2422 may be filled with the second filler material 2452 via one of a third port 2463 and a fourth port 2464 while the other of the third port 2463 and the fourth port 2464 may provide relief for air and any excess second filler material 2452. The first, second, third, and fourth ports 2461, 2462, 2463, and 2464 may be similar in many respects to any ports described herein configured to communicate with an interior cavity of a body portion. Accordingly, the first, second, third, and fourth ports 2461, 2462, 2463, and 2464 may each be configured to receive a plug portion and a weight portion. With respect to the present example, the interior cavity 2420 may be closed off by a sole plate as described herein or have a unibody sole portion such that access to the interior cavity 2420 may be provided exclusively via the first, second, third, and fourth ports 2461, 2462, 2463, and 2464. The apparatus, methods, and articles of manufacture described herein are not limited in this regard.

While each of the above examples may describe a certain type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, a putter-type golf club head, etc.).

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cubic centimeters ($cm^3$ or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby," "neighboring," etc., and such terms may be used interchangeably as appearing in this disclosure.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods, and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having a toe portion, a heel portion, a front portion, a rear portion, a top portion, a sole portion, and an interior cavity defining a first interior cavity space and a second interior cavity space;

a face portion at the front portion;

a first set of ports comprising:

a first port at the sole portion and disposed at or proximate the front portion, the first port in communication with the interior cavity; and a second port at the sole portion and disposed at or proximate the rear portion, the second port in communication with the interior cavity;

a first weight portion coupled to the first port;

a second weight portion coupled to the second port;

a second set of ports separate from the interior cavity;

an opening at the sole portion;

a sole plate coupled to the body portion to cover the opening, the sole plate having a depression and a through-port extending into the interior cavity and in communication with the interior cavity;

a sole plate cover coupled to the depression to cover the through-port;

a first filler material partially or entirely filling the first interior cavity space; and a second filler material partially or entirely filling the second interior cavity space, wherein the first set of ports and the second set of ports are peripherally located at the sole portion, wherein the sole plate is disposed between the first set of ports and the second set of ports, wherein the through-port is disposed between the first port and the second port, wherein the first filler material abuts a rear surface of the face portion, and wherein the second filler material at least partially encases the through-port.

2. A golf club head as defined in claim 1, wherein the interior cavity defines a volume that is greater than or equal to 80% of a volume of the body portion.

3. A golf club head as defined in claim 1, wherein the first interior cavity space has a volume that is less than a volume of the second interior cavity space.

4. A golf club head as defined in claim 1, wherein the first filler material includes a solid polymer material, and wherein the second filler material includes a foam polymer material.

5. A golf club head as defined in claim 1, wherein the first port and the second port each include a first port section and a second port section extending upwardly from the first portion and directly connected to the interior cavity, wherein the first weight portion is coupled to the first port section of the first port and the second weight portion is coupled to the first port section of the second port, wherein a first plug portion is coupled to the second port section of the first port and a second plug portion is coupled to the second port section of the second port, and wherein the first and second plug portions restrict access to the interior cavity.

6. A golf club head as defined in claim 1, wherein each port of the second set of ports is coupled to a corresponding weight portion being interchangeable with any one of the first weight portion and the second weight portion.

7. A golf club head as defined in claim 1, wherein the second filler material has a hardness rating that is different from a hardness rating of the first filler material.

8. A golf club head comprising:

a body portion formed from a first material, the body portion having a toe portion, a heel portion, a front portion, a rear portion, a top portion, a sole portion, and an interior cavity defining a first interior cavity space and a second interior cavity space;

a first port at or proximate the front portion and in communication with the interior cavity;

a second port at or proximate the rear portion and in communication with the interior cavity;

a first weight portion coupled to the first port;

a second weight portion coupled to the second port;

an opening at the sole portion;

a sole plate formed from a second material and coupled to the body portion to close the opening, the sole plate having a depression and a through-port in communication with the interior cavity;

a sole plate cover formed from a third material and coupled to the depression to cover the through-port;

a first filler material partially or entirely filling the first interior cavity space, the first filler material formed from a fourth material; and a second filler material partially or entirely filling the second interior cavity space, the second filler material formed from a fifth material, wherein the first, second, third, fourth, and fifth materials are different from one another, and wherein the fifth material has a density that is less than a density of the fourth material.

9. A golf club head as defined in claim 8, wherein the first port communicates with the first interior cavity space, and wherein the through-port and the second port each communicate with the second interior cavity space.

10. A golf club head as defined in claim 8, wherein the interior cavity has a lateral length that is greater than or equal to 90% of a lateral length of the body portion, wherein the interior cavity has a center longitudinal length that is greater than or equal to 90% of a center longitudinal length of the body portion, and wherein the interior cavity has a height that is greater than or equal to 90% of a height of the body portion.

11. A golf club head as defined in claim 8, wherein the first material includes a tungsten-nickel alloy material, wherein the second material includes a steel material, and wherein the sole plate cover includes a nickel material.

12. A golf club head as defined in claim 8, wherein the first filler material includes a solid polymer material and the second filler material includes a foam polymer material.

13. A golf club head as defined in claim 8, wherein the body portion has a wall thickness at one or more of the toe portion, the heel portion, the front portion, the rear portion, the top portion, and the sole portion that is less than or equal to 0.060 inch.

14. A golf club head comprising:

a body portion having a toe portion, a heel portion, a front portion, a rear portion, a top portion, a sole portion, and an interior cavity defining a first interior cavity space and a second interior cavity space;

an opening at the sole portion;

a first port in communication with the interior cavity;

a second port in communication with the interior cavity;

a sole plate coupled to the body portion to close the opening, the sole plate having a through-port in communication with the interior cavity;

a first filler material partially or entirely filling the first interior cavity space; and a second filler material partially or entirely filling the second interior cavity space, wherein the second interior cavity space has a volume that is greater than a volume of the first interior cavity space, wherein the second interior cavity space is located rearward of the first interior cavity space, wherein the first filler material includes a solid polymer material, and wherein the second filler material includes a foam polymer material.

15. A golf club head as defined in claim 14, wherein the first interior cavity space is filled with the first filler material via the first port, and wherein the second interior cavity space is filled with the second filler material via the through-port.

16. A golf club head as defined in claim 14, wherein the first filler material has a hardness rating falling within a Shore D durometer hardness scale, and wherein the second filler material has a hardness rating falling within an Asker F durometer hardness scale.

17. A golf club head as defined in claim 14, wherein the first filler material includes an adhesive epoxy material, and wherein the second filler material includes a urethane foam.

18. A golf club head as defined in claim 14, wherein the first port and the second port are each located at the sole portion and are each configured to receive a corresponding weight portion and a corresponding plug portion for closing off the first port and the second port to the interior cavity.

19. A golf club head as defined in claim 14, wherein the through-port extends into the second interior cavity space and is at least partially encased by the second filler material.

20. A golf club head as defined in claim 14, configured as a putter-type golf club head.

* * * * *